US007500898B2

(12) United States Patent
Laurienzo et al.

(10) Patent No.: US 7,500,898 B2
(45) Date of Patent: Mar. 10, 2009

(54) TOY FOR ROTATING AND LAUNCHING AN OBJECT

(75) Inventors: Dominic Laurienzo, Los Angeles, CA (US); Cuong Phu Bui, Agoura, CA (US)

(73) Assignee: JAKKS Pacific, Incorporation, Malibu, CA (US)

( * ) Notice: Subject to any disclaimer, the term of this patent is extended or adjusted under 35 U.S.C. 154(b) by 197 days.

(21) Appl. No.: 11/183,118

(22) Filed: Jul. 14, 2005

(65) Prior Publication Data

US 2006/0046610 A1 Mar. 2, 2006

Related U.S. Application Data

(60) Provisional application No. 60/604,283, filed on Aug. 25, 2004.

(51) Int. Cl.

| | |
|---|---|
| ***A63H 27/127*** | (2006.01) |
| ***A63H 17/00*** | (2006.01) |
| ***A63H 17/28*** | (2006.01) |
| ***A63H 17/32*** | (2006.01) |
| ***A63H 29/00*** | (2006.01) |

(52) U.S. Cl. ..... 446/39; 446/429; 446/430

(58) Field of Classification Search ..... 446/34, 446/36–48, 429, 430; 74/89.17, 422, 411.5
See application file for complete search history.

(56) References Cited

U.S. PATENT DOCUMENTS

| | | | | |
|---|---|---|---|---|
| 755,446 | A * | 3/1904 | Smith | 446/233 |
| 1,473,419 | A | 11/1923 | Gudlipp | |
| 3,216,529 | A | 11/1965 | Lohr | |
| 3,701,216 | A | 10/1972 | Smith, III et al. | |
| 3,886,682 | A | 6/1975 | Ieda et al. | |
| 3,935,669 | A | 2/1976 | Potrzuski et al. | |
| 4,155,194 | A | 5/1979 | Amamoto et al. | |
| 4,193,597 | A * | 3/1980 | Ogawa | 446/4 |
| 4,267,661 | A | 5/1981 | Hanson | |
| D266,097 | S | 9/1982 | Klawitter | |
| 4,363,186 | A | 12/1982 | Goldfarb et al. | |
| 4,479,326 | A * | 10/1984 | Kennedy et al. | 446/429 |
| 4,498,886 | A | 2/1985 | Goldfarb et al. | |
| 4,526,554 | A | 7/1985 | Goldfarb et al. | |

(Continued)

FOREIGN PATENT DOCUMENTS

| | | |
|---|---|---|
| EP | 0 332 407 | 9/1989 |

(Continued)

*Primary Examiner*—Gene Kim
*Assistant Examiner*—Urszula M Cegielnik
(74) *Attorney, Agent, or Firm*—Tope-McKay & Associates

(57) ABSTRACT

A toy comprises a housing connected with a launcher to rotate and launch an object. The launcher comprises a driving element to form a drive connection with a receiving element on the object. The launcher is connected with a launcher rotating system, which imparts a rotary movement to the launcher. When the launcher ceases to accelerate the object, the receiving element disengages from the drive connection and launches the object. In one aspect, the launcher rotating system is a gear train capable of being rotated by a gear rack pulled by a user. The launcher is configured to release the object in only one direction, and a stopper prevents the launcher rotating system from rotating the object in an undesirable direction. The toy is also configured to launch multiple objects simultaneously or load multiple objects to launch in sequence.

5 Claims, 21 Drawing Sheets

U.S. PATENT DOCUMENTS

| | | | | | |
|---|---|---|---|---|---|
| 4,659,320 | A | | 4/1987 | Rich et al. | |
| 4,689,034 | A | | 8/1987 | Dubois et al. | |
| 4,732,569 | A | | 3/1988 | Hippley et al. | |
| 4,756,703 | A | | 7/1988 | Kennedy et al. | |
| 4,795,396 | A | | 1/1989 | Lindstrom | |
| 4,841,902 | A | * | 6/1989 | Gubin | 116/62.4 |
| D302,191 | S | | 7/1989 | Larkin | |
| 4,889,513 | A | | 12/1989 | Paddock | |
| 4,959,035 | A | * | 9/1990 | Murasaki | 446/40 |
| D315,758 | S | | 3/1991 | Watanabe | |
| 5,083,799 | A | | 1/1992 | Thill | |
| 5,305,068 | A | * | 4/1994 | Sato et al. | 399/317 |
| 5,370,571 | A | | 12/1994 | Bosch | |
| 5,433,641 | A | | 7/1995 | Rudell et al. | |
| 5,525,086 | A | * | 6/1996 | Gentile et al. | 446/41 |
| 5,536,074 | A | | 7/1996 | Hsu et al. | |
| 5,545,068 | A | | 8/1996 | Asbaghi | |
| 5,580,093 | A | | 12/1996 | Conway | |
| 5,593,338 | A | * | 1/1997 | Itoh et al. | 446/259 |
| 5,611,322 | A | | 3/1997 | Matsuzaki et al. | |
| D380,503 | S | | 7/1997 | Tyler | |
| 5,643,036 | A | * | 7/1997 | Liu et al. | 446/429 |
| 5,683,164 | A | | 11/1997 | Chien | |
| D390,284 | S | | 2/1998 | Mak | |
| 5,738,079 | A | | 4/1998 | Keller et al. | |
| D395,464 | S | | 6/1998 | Shiibashi et al. | |
| 5,782,228 | A | | 7/1998 | Wu | |
| 5,873,600 | A | | 2/1999 | Conway | |
| D410,970 | S | | 6/1999 | Larian | |
| D412,019 | S | | 7/1999 | Wu | |
| 5,957,541 | A | | 9/1999 | Seigler | |
| 6,048,280 | A | | 4/2000 | Palmer et al. | |
| 6,076,511 | A | | 6/2000 | Grimm et al. | |
| 6,089,946 | A | | 7/2000 | Yang | |
| D434,086 | S | | 11/2000 | Ford | |
| 6,221,409 | B1 | * | 4/2001 | Bueno Ceresuela | 426/104 |
| D444,820 | S | | 7/2001 | Knaub et al. | |
| D451,557 | S | | 12/2001 | Yu | |
| 6,523,535 | B2 | | 2/2003 | Rehkemper et al. | |
| 6,565,243 | B1 | | 5/2003 | Cheung | |
| 6,619,823 | B2 | | 9/2003 | Dai | |
| 6,758,203 | B1 | * | 7/2004 | Wu | 124/6 |
| 6,776,458 | B1 | | 8/2004 | Wang | |
| D498,447 | S | | 11/2004 | Kato | |
| 6,851,817 | B2 | | 2/2005 | Wong | |
| 2002/0098768 | A1 | * | 7/2002 | Kuo et al. | 446/39 |
| 2004/0085777 | A1 | | 5/2004 | Wong | |
| 2004/0125612 | A1 | | 7/2004 | Jackson | |
| 2004/0218397 | A1 | | 11/2004 | Luo | |
| 2004/0257825 | A1 | | 12/2004 | Choi et al. | |
| 2005/0030756 | A1 | | 2/2005 | Thomas et al. | |
| 2005/0082774 | A1 | | 4/2005 | Chiu | |
| 2006/0046609 | A1 | | 3/2006 | Laurienzo et al. | |

FOREIGN PATENT DOCUMENTS

| | | |
|---|---|---|
| GB | 2 389 321 | 12/2003 |
| WO | WO 03/076034 | 9/2003 |
| WO | WO 2006/025837 | 3/2006 |

* cited by examiner

TOY FOR ROTATING AND LAUNCHING AN OBJECT

PRIORITY CLAIM

The present application claims the benefit of priority of U.S. Provisional Patent Application No. 60/604,283, filed Aug. 25, 2004, entitled "Wheel Spinning Launcher and Wheel Toy."

BACKGROUND OF THE INVENTION (1) Technical Field

The present invention relates to a toy for rotating and launching an object, and more particularly to a launching mechanism for rotating and launching an object that provides for the safety of a user.

(2) Description of Related Art

Toy launchers are well known in the art. Toys that accelerate and launch gliders, helicopters, cars, and parachutes are well documented. One method of launching a toy is through a rotary motion, often utilizing a gear system to turn a shaft that rotates the toy.

An example of one launcher disclosed in U.S. Pat. No. 3,701,216, issued to Smith, III et al. (hereinafter "the Smith patent"). The launcher taught in the Smith patent uses a gear rack to drive a gear train and rotate a wheel that is mounted on a shaft. As the gear rack is withdrawn from the toy, a wheel ejector coupled to the gear rack pivots to force the wheel off of the shaft and launch the wheel.

The devices according to the Smith patent have several shortcomings, the first of which is the need for a separate mechanical ejector to release the wheel from the toy. In addition to adding to the cost to manufacture the toy, the wheel ejector device adds to the complexity of design of the toy.

Another shortcoming of the devices made according to the Smith patent is the possibility of causing injury to the user if the wheel is launched in the direction of the user. If the toy is particularly oriented, the wheel will rotate and launch toward the user, risking injury.

Therefore, a need exists for a toy launcher with a cost-effective launching mechanism built into the design of the toy and capable of preventing the toy from being launched in the direction of the user.

SUMMARY OF THE INVENTION

The present invention overcomes the aforementioned limitations and fills the aforementioned needs by providing a toy for rotating and launching an object.

In one aspect, a toy for rotating and launching an object, comprising a housing; a launcher extending from the housing, the launcher configured to impart a rotary motion to an object, wherein the launcher comprises a driving element configured to engage a receiving element, the receiving element attached with an object to form a drive connection, such that when the driving element engages the receiving element, the object is rotationally accelerated in one direction, and wherein once the driving element ceases to accelerate the receiving element, the receiving element disengages from the driving element and releases the object from the drive connection; and a launcher rotating system mounted inside the housing and connected with the launcher, the launcher rotating system configured to impart a rotary motion to the launcher.

In another aspect, the driving element comprises two substantially helical tabs extending in a parallel configuration from the shaft about an axis, the axis running substantially parallel to and substantially centered in the shaft, and wherein the receiving element of the object is similarly configured with two substantially helical tabs extending outward in parallel configuration about an axis, the axis running perpendicular to the rotational motion of the object, and wherein the two substantially helical tabs of each of the driving element and receiving element has an edge that runs parallel to the axis of the respective driving element and receiving element, such that the edge of the driving element rests flush against the edge of the receiving element, forming a drive connection which allows the rotation of the driving element to rotate the receiving element.

In another aspect, the edge of the driving element and the edge of the receiving element are formed as matching and interlocking shapes, such that when the edge of the driving element is matched with the edge of the receiving element, an interlocking drive connection is formed.

In another aspect, the edge of the driving element and the edge of the receiving element are formed as a hook shapes, such that when the edge of the driving element is matched up with the edge of the receiving element, an interlocking drive connection is formed.

In another aspect, the launcher rotating system comprises a series of interconnected gears and axles, the gears and axles capable of rotating the launcher.

In another aspect, the series of interconnected gears and axles comprises an output axle connected with the launcher, the output axle coupled with an output gear, the output gear drivingly connected with an input gear on an input axle, the input axle connected with an input pinion, the input pinion in drivingly connected with a gear rack, said gear rack movably mounted in a guideway in the housing, said gear rack capable of moving to rotate the input pinion and thereby rotate the launcher rotating system.

In another aspect, the radius of the gears is selected to provide a desired input-to-output gear ratio.

In another aspect, the launcher rotating system comprises a motor configured to rotate the launcher.

In another aspect, a stopper configured to selectively engage the gear rack and permit the gear rack to rotate the launcher rotating system in only one direction.

In another aspect, the stopper is rotationally mounted to the launcher rotating system.

In another aspect, the stopper consists of a set of teeth configured to interact with the gear rack and stop the movement of the gear rack.

In another aspect, the stopper is rotationally connected with the housing such that the stopper engages the gear rack when the housing is in an undesirable orientation.

In another aspect, the stopper is rotationally connected with the housing, such that the undesirable orientation occurs when the object would be launched in the direction of a user.

In another aspect, the toy further includes an object, the object being rotationally connected with the receiving element to be rotationally accelerated by the driving element.

In another aspect, the object is a wheel, and wherein the receiving element is rotationally connected with the hub of the wheel such that when the receiving element forms a drive connection with the driving element, the movement of the gear rack causes the wheel to rotate.

In another aspect, the wheel further comprises a detachably attachable toy brake rotor, and wherein the toy brake rotor comprises an inner ring and an outer ring.

In another aspect, the toy brake rotor is detachably attached with the receiving element of the wheel.

In another aspect, the toy brake rotor is connected with the receiving element by a pair of protrusions that frictionally fit within a corresponding pair of grooves that extend in parallel with the axis along the outer wall of the receiving element to permit the pair of protrusions to move parallel to the axis within the grooves and lock therein.

In another aspect, the toy brake rotor further comprises a toy brake caliper formed on the outer ring of the toy brake rotor.

In another aspect, the wheel is transparent, and wherein the toy brake rotor further comprises a light and a power source.

In another aspect, the light is a light emitting diode ("LED").

In another aspect, the power source is comprised of two button cell batteries.

In another aspect, the power source is configured to be activated by the rotational movement of the wheel.

In another aspect, the housing further comprises a handle to permit a user to easily grip the housing.

In another aspect, the driving element comprises two substantially helical tabs extending in a parallel configuration from the launcher about an axis, the axis running substantially parallel to and substantially centered in the launcher, and wherein the receiving element of the object is similarly configured with two substantially helical tabs extending outward in parallel configuration about an axis, the axis running perpendicular to the rotational motion of the object, and wherein the two substantially helical tabs of each of the driving element and receiving element has an edge that runs parallel to the axis of the respective driving element and receiving element, such that the edge of the driving element rests flush against the edge of the receiving element, forming a drive connection which allows the rotation of the driving element to rotate the receiving element.

In another aspect, the edge of the driving element and the edge of the receiving element are formed as matching and interlocking shapes, such that when the edge of the driving element is matched with the edge of the receiving element, an interlocking drive connection is formed.

In another aspect, the edge of the driving element and the edge of the receiving element are formed as a hook shapes, such that when the edge of the driving element is matched up with the edge of the receiving element, an interlocking drive connection is formed.

In another aspect, the launcher rotating system comprises a series of interconnected gears and axles, the gears and axles capable of rotating the launcher.

In another aspect, the series of interconnected gears and axles comprises an output axle connected with the launcher, the output axle coupled with an output gear, the output gear drivingly connected with an input gear on an input axle, the input axle connected with an input pinion, the input pinion in drivingly connected with a gear rack, said gear rack movably mounted in a guideway in the housing, said gear rack capable of moving to rotate the input pinion and thereby rotate the launcher rotating system.

In another aspect, the radius of the gears is selected to provide a desired input-to-output gear ratio.

In another aspect, the launcher rotating system comprises a motor configured to rotate the launcher.

In another aspect, a stopper configured to selectively engage the gear rack and permit the gear rack to rotate the launcher rotating system in only one direction.

In another aspect, the stopper is rotationally mounted to the launcher rotating system.

In another aspect, the stopper consists of a set of teeth configured to interact with the gear rack and stop the movement of the gear rack.

In another aspect, the stopper is rotationally connected with the housing such that the stopper engages the gear rack when the housing is in an undesirable orientation.

In another aspect, the undesirable orientation occurs when the object would be launched in the direction of a user.

In another aspect, a first launcher and a second launcher extending from the housing such that two objects can be rotated and launched.

In another aspect, the driving element of the first launcher and the driving element of the second launcher comprise two substantially helical tabs extending in a parallel configuration from the launcher about an axis, the axis running substantially parallel to and substantially centered in the launcher, and wherein the receiving element of the object is similarly configured with two substantially helical tabs extending outward in parallel configuration about an axis, the axis running perpendicular to the rotational motion of the object, and wherein the two substantially helical tabs of each of the driving element and receiving element has an edge that runs parallel to the axis of the respective driving element and receiving element, such that the edge of the driving element rests flush against the edge of the receiving element, forming a drive connection which allows the rotation of the driving element to rotate the receiving element.

In another aspect, the edge of the driving element and the edge of the receiving element are formed as matching and interlocking shapes, such that when the edge of the driving element is matched with the edge of the receiving element, an interlocking drive connection is formed.

In another aspect, the edge of the driving element and the edge of the receiving element are formed as a hook shapes, such that when the edge of the driving element is matched up with the edge of the receiving element, an interlocking drive connection is formed.

In another aspect, the launcher rotating system comprises a series of interconnected gears and axles, the gears and axles capable of rotating the first and second launchers.

In another aspect, the series of interconnected gears and axles comprises an output axle with a first end and a second end, the first end connected with the first launcher and the second end connected with the second launcher, the output axle drivingly connected with an output gear, the output gear drivingly connected with an input gear on an input axle, the input axle connected with an input pinion, the input pinion drivingly connected with a gear rack, said gear rack movably mounted in a guideway in the housing, said gear rack capable of moving to rotate the input pinion and thereby rotate the launcher rotating system.

In another aspect, the gear rack also rotates a measurement gear, said measurement gear rotationally connected with a measurement shaft, said measurement shaft having a rotation and rotationally connected with a gauge for measuring the rotational velocity of the measurement shaft.

In another aspect, the gauge measures the rotation of the measurement shaft in revolutions per minute ("RPMs").

In another aspect, the housing further comprises a detachably attachable clip for loading a plurality of objects in sequence, and wherein the clip is formed such that the objects are sequentially loaded into the launcher rotating system, such that as one object is rotated and launched, another object is loaded for into the launcher rotating system.

In another aspect, the clip comprises a central groove to hold each object on the clip.

In another aspect, the toy further includes an object, the object being rotationally connected with the receiving element to be rotationally accelerated by the driving element.

In another aspect, the receiving element of the object is detachably attached with a receiving element adaptor; said receiving element adaptor configured with a disc portion, a gear portion, and a driving element portion, the disc portion, gear portion, and driving element portion connected by a central shaft; the disc portion configured to load into the central groove of the clip, the gear portion configured to interact with the launcher rotating system, and the driving element portion configured with a driving element to connect with the receiving element of the object and form a drive connection.

In another aspect, the gear portion is connected with the driving element portion such that when the gear portion is rotated by the launcher rotating system, the driving element portion is simultaneously rotated.

In another aspect, the launcher rotating system comprises an axle with an output portion and an input portion, the output portion comprising an output gear to interact with the gear portion of the receiving element adaptor, and wherein the input portion of the axle comprises an input pinion to interact with a gear rack.

In another aspect, the gear rack is movably mounted in a guideway in the housing, the gear rack capable of moving to rotate the input pinion.

In another aspect, the housing further comprises an object loading system configured to activate a load lever to release the receiving element adaptor from the clip and load the receiving element adaptor into a driving connection with the launcher rotating system.

In another aspect, the object loading system is activated by the gear rack.

In another aspect, the object loading system is further configured to activate a release lever to release the receiving element adaptor from the launcher rotating system after the object has been released from the drive connection of the driving element and receiving element.

In another aspect, the housing further comprises a guide configured to receive the disc portion of the receiving element adaptor after the receiving element adaptor has been released from the launcher rotating system, and wherein the guide directs the element adaptor to a desired location.

In another aspect, the housing is formed in a race car shape, the race car shape substantially enclosing the launcher rotating system and gear rack, and wherein the housing comprises a pathway to allow the object to exit the housing once the object has been released from the receiving element adaptor.

In another aspect, a toy for rotating and launching an object, comprising a housing; a launcher extending from the housing, the launcher configured to impart a rotary motion to an object, wherein the launcher comprises a driving element configured to engage a receiving element, the receiving element attached with an object to form a drive connection, such that when the driving element engages the receiving element, the object is rotationally accelerated in one direction, and wherein once the driving element ceases to accelerate the receiving element, the receiving element disengages from the driving element and releases the object from the drive connection; a launcher rotating system mounted inside the housing and connected with the launcher, the launcher rotating system configured to impart a rotary motion to the launcher; and a stopper configured to selectively engage the launcher rotating system and permit the launcher to rotate in only one direction.

In another aspect, the stopper is rotationally mounted to the launcher rotating system.

In another aspect, the launcher rotating system comprises a series of interconnected gears and axles, the gears and axles capable of rotating the launcher.

In another aspect, the series of interconnected gears and axles comprises an output axle connected with the launcher, the output axle coupled with an output gear, the output gear drivingly connected with an input gear on an input axle, the input axle connected with an input pinion, the input pinion in drivingly connected with a gear rack, said gear rack movably mounted in a guideway in the housing, said gear rack capable of moving to rotate the input pinion and thereby rotate the launcher rotating system.

In another aspect, the stopper is rotationally mounted to the output axle of the launcher rotating system.

In another aspect, the stopper comprises a set of teeth configured to interact with the gear rack and prevent the movement of the gear rack.

In another aspect, the stopper engages the gear rack when the housing is in an undesirable orientation.

In another aspect, the undesirable orientation occurs when the object would be launched in the direction of a user.

In another aspect, a method for making a toy for rotating and launching an object, the method comprising acts of forming a housing; forming a launcher extending from the housing, the launcher configured to impart a rotary motion to an object, wherein the launcher comprises a driving element configured to engage a receiving element, the receiving element attached with an object to form a drive connection, such that when the driving element engages the receiving element, the object is rotationally accelerated in one direction, and wherein once the driving element ceases to accelerate the receiving element, the receiving element disengages from the driving element and releases the object from the drive connection; and mounting a launcher rotating system inside the housing and connecting the launcher rotating system with the launcher, the launcher rotating system configured to impart a rotary motion to the launcher.

In another aspect, the method comprises the act of forming the driving element of two substantially helical tabs extending in a parallel configuration from the shaft about an axis, the axis running substantially parallel to and substantially centered in the shaft, and wherein the receiving element of the object is similarly configured with two substantially helical tabs extending outward in parallel configuration about an axis, the axis running perpendicular to the rotational motion of the object, and wherein the two substantially helical tabs of each of the driving element and receiving element has an edge that runs parallel to the axis of the respective driving element and receiving element, such that the edge of the driving element rests flush against the edge of the receiving element, forming a drive connection which allows the rotation of the driving element to rotate the receiving element.

In another aspect, the method comprises the act of forming the edge of the driving element and the edge of the receiving element as matching and interlocking shapes, such that when the edge of the driving element is matched with the edge of the receiving element, an interlocking drive connection is formed.

In another aspect, the method comprises the act of forming the edge of the driving element and the edge of the receiving element as hook shapes, such that when the edge of the driving element is matched up with the edge of the receiving element, an interlocking drive connection is formed.

BRIEF DESCRIPTION OF THE DRAWINGS

The objects, features and advantages of the present invention will be apparent from the following detailed descriptions of the disclosed aspects of the invention in conjunction with reference to the following drawings, where.

DETAILED DESCRIPTION

Figure 1A:
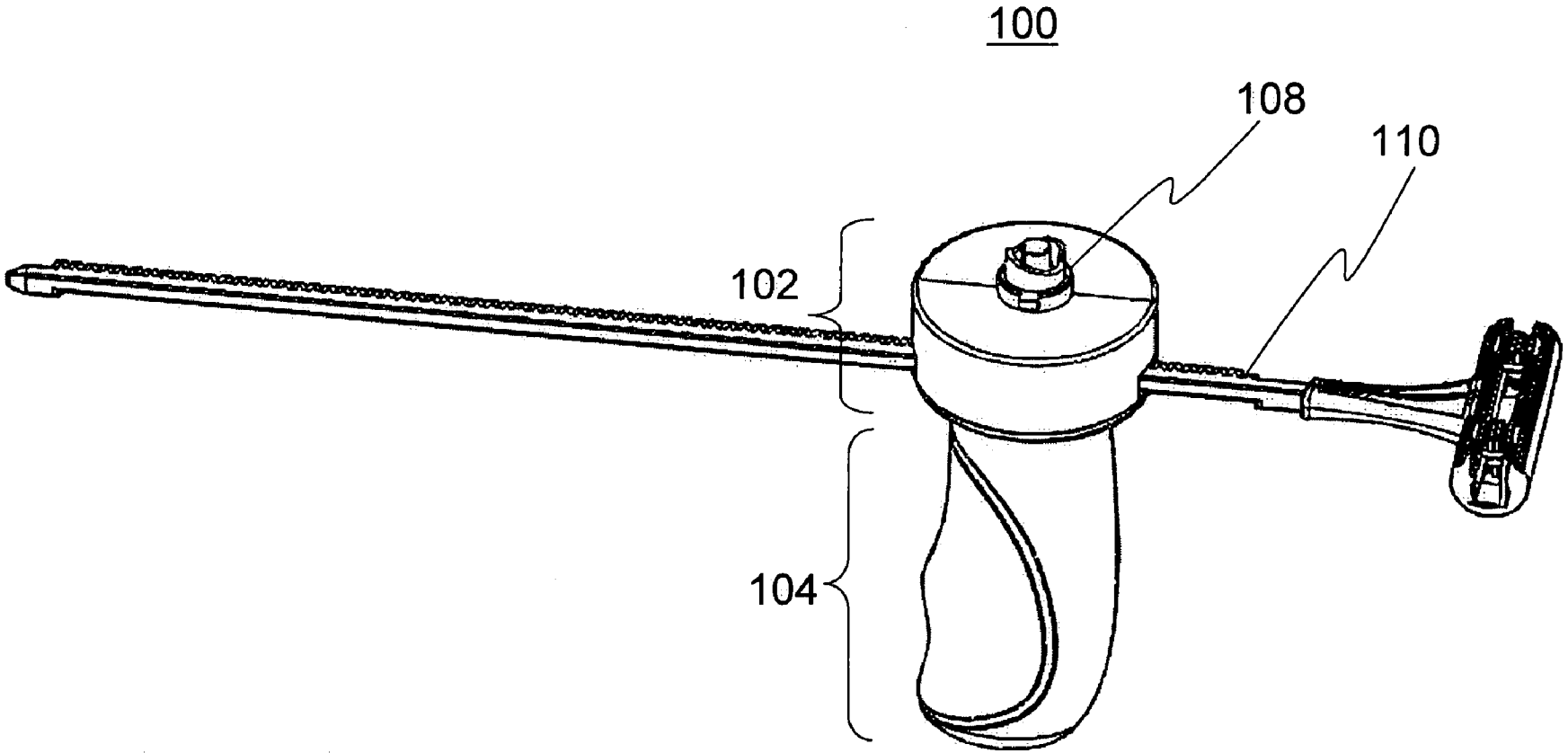
FIG. 1A is an exemplary illustration of a toy according to the present invention,depicting a housing, a handle, a launcher and a gear rack.

The present invention relates to a toy for rotating and launching an object. More specifically, the present invention relates to a launching mechanism for rotating and launching an object that provides for the safety of a user. The following description, taken in conjunction with the referenced drawings, is presented to enable one of ordinary skill in the art to make and use the invention and to incorporate it in the context of particular applications. Various modifications, as well as a variety of uses in different applications, will be readily apparent to those skilled in the art, and the general principles, defined herein, may be applied to a wide range of aspects. Thus, the present invention is not intended to be limited to the aspects presented, but is to be accorded the widest scope consistent with the principles and novel features disclosed herein. Furthermore, it should be noted that unless explicitly stated otherwise, the figures included herein are illustrated diagrammatically and without any specific scale, as they are provided as qualitative illustrations of the concept of the present invention.

In the following detailed description, numerous specific details are set forth in order to provide a more thorough understanding of the present invention. However, it will be apparent to one skilled in the art that the present invention may be practiced without necessarily being limited to these specific details. In other instances, well-known structures and devices are shown in block diagram form, rather than in detail, in order to avoid obscuring the present invention.

The reader's attention is directed to all papers and documents that are filed concurrently with this specification and are open to public inspection with this specification, and the contents of all such papers and documents are incorporated herein by reference. All the features disclosed in this specification, (including any accompanying claims, abstract, and drawings) may be replaced by alternative features serving the same, equivalent or similar purpose, unless expressly stated otherwise. Thus, unless expressly stated otherwise, each feature disclosed is one example only of a generic series of equivalent or similar features.

Furthermore, any element in a claim that does not explicitly state "means for" performing a specified function, or "step for" performing a specific function, is not to be interpreted as a "means" or "step" clause as specified in 35 U.S.C. Section 112, Paragraph 6. In particular, the use of "step of" or "act of" in the claims herein is not intended to invoke the provisions of 35 U.S.C. 112, Paragraph 6.

Before describing the invention in detail, an introduction is provided to provide the reader with a general understanding of the present invention. Next, a description of various aspects of the present invention is provided to give an understanding of the specific details.

(1) Introduction

The present invention relates to a toy for rotating and launching an object. More specifically, the present invention relates to a launcher to hold, rotate and release an object such as a wheel. A launcher with a pair of helical tabs extends from a shaft on the toy and interlocks with matching tabs on an object to mount the object on the shaft. In one aspect, a removable gear rack is pulled to rotate a gear train in the toy, which in turn rotates the shaft and the launcher, thereby rotating the object mounted to the launcher. When the launcher ceases to accelerate the object, the tabs of the object disengage from the launcher, launching the object forward. The launcher is configured to release the object in only one direction, and a stopper gear will prevent the toy from rotating the object in the direction of a user. The toy, in another aspect, provides for launching two objects or loading multiple objects to launch in sequence.

(2) Basic Function of the Toy

Figure 1B:
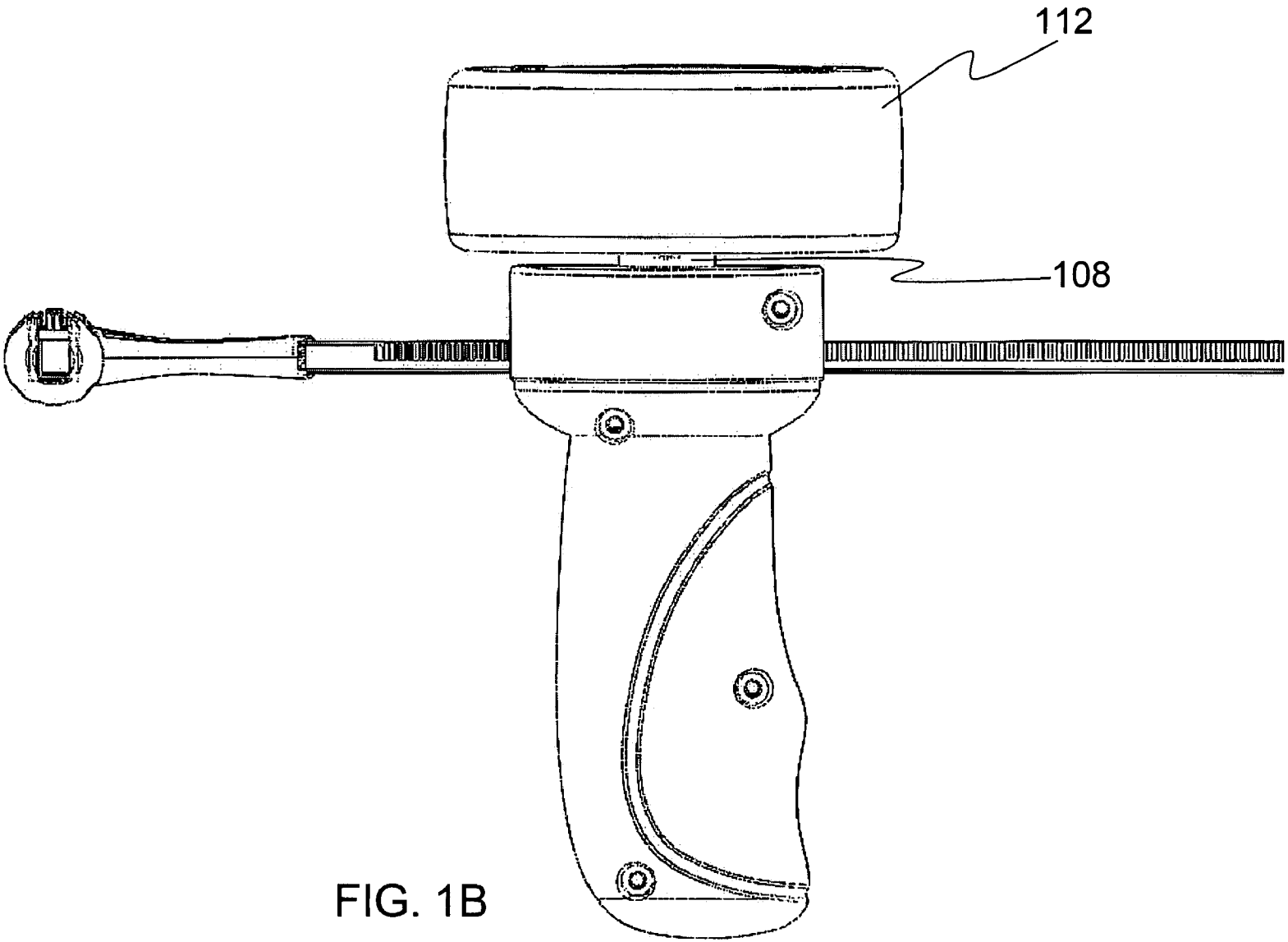
FIG. 1B is an exemplary illustration of a toy according to the present invention, depicting a wheel rotationally connected to the launcher.

In one aspect, as illustrated in FIG. 1A, the toy 100 comprises a housing 102, a handle 104, a launcher 106, and a launcher rotating system (not illustrated) including a gear rack 108. The launcher rotating system is located inside the housing 102, and the launcher rotating system is drivingly connected with the gear rack 108 such that when the gear rack 108 is moved, the launcher rotating system translates the movement of the gear rack 108 into a rotary motion. The launcher rotating system is then drivingly connected with the launcher 106. When an object such as a wheel 110 is connected with the launcher 106, as in FIG. 1B, the launcher 106 rotationally accelerates the wheel 110 until the wheel 110 is released from the launcher 106 and propelled forward.

Although a gear rack 108 is shown in the aspect of FIG. 1A, one skilled in the art will appreciate that the launcher rotating system can comprise a motor or other manually operated mechanism to cause the rotation of the launcher 106.

(3) Launcher Mechanism

Figure 2A:
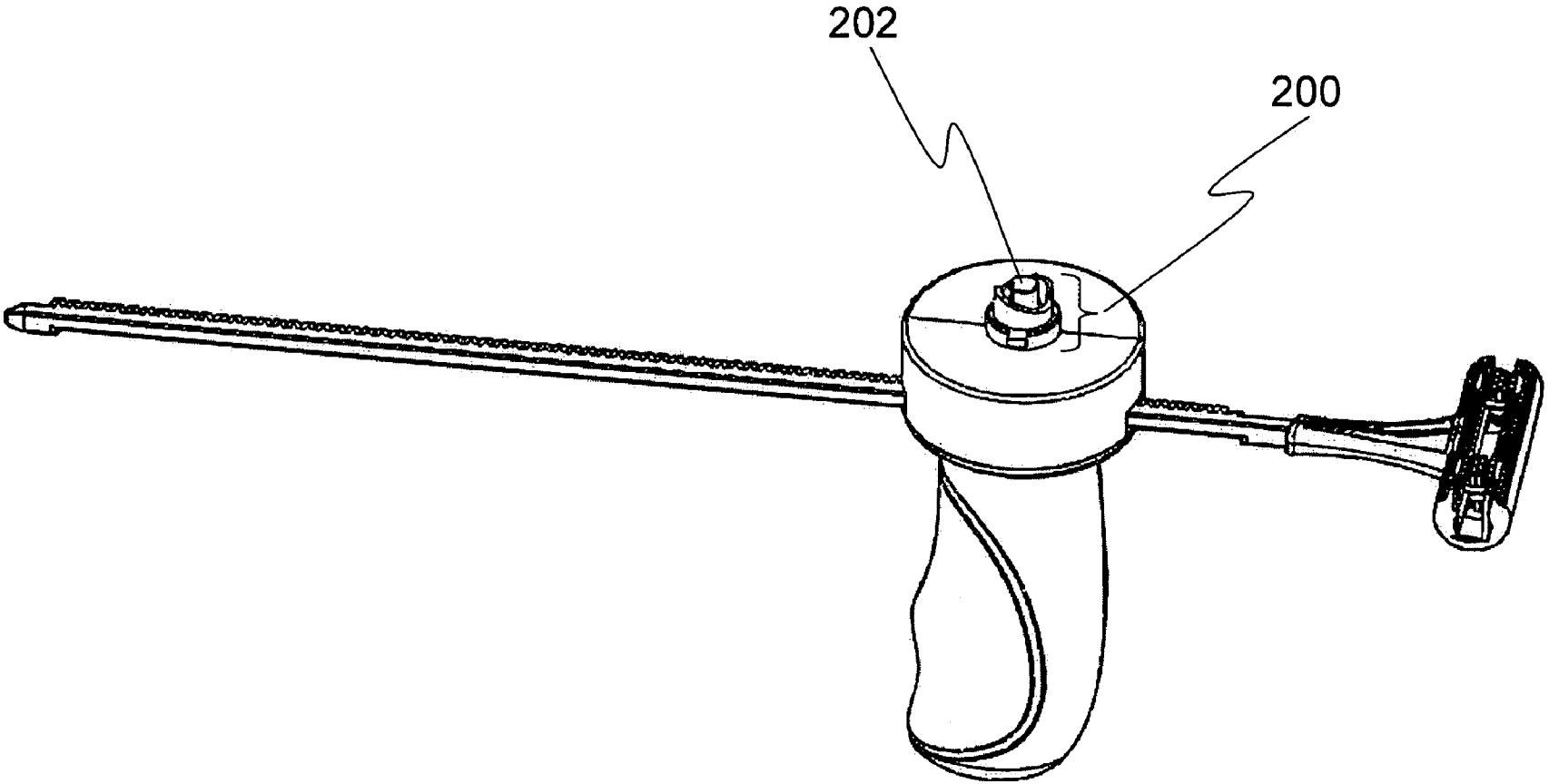
FIG. 2A is an exemplary illustration of a toy according to the present invention, further depicting the launcher.
Figure 2B:
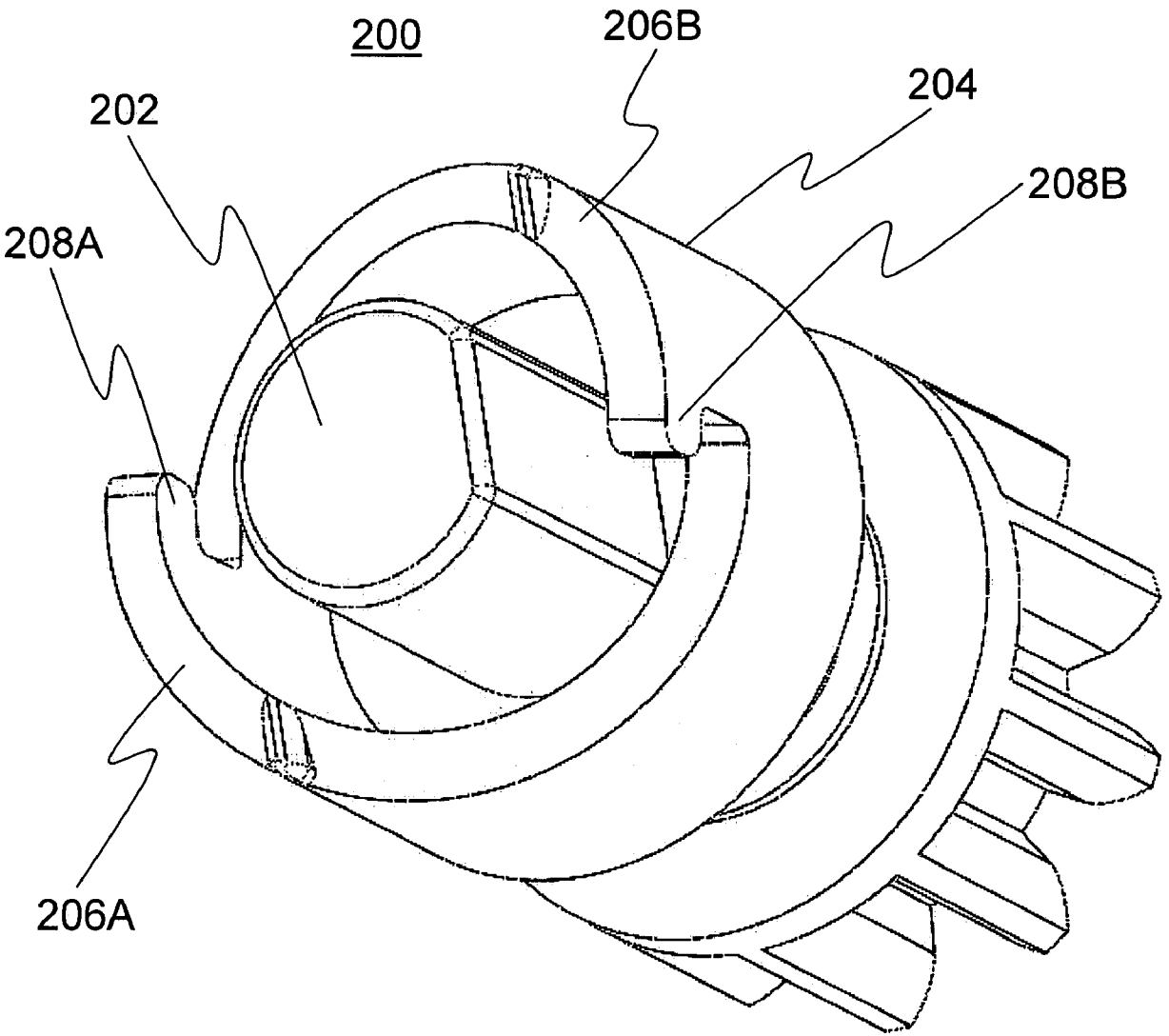
FIG. 2B is an exemplary illustration of a toy according to the present invention, depicting the structure of a driving element of the launcher.

The launcher functions to retain an object, rotate the object, and launch the object, without the need for a manual or mechanical release mechanism. In one aspect, as illustrated in FIG. 2A, the launcher 200 is mounted to an output axle 202 which is drivingly connected with the launcher rotating system (not illustrated). FIG. 2B illustrates the specific design of one aspect of the launcher 200, including a driving element 204. The driving element comprises two identical helical tabs 206A and 206B, which extend outward in parallel configuration from the output axle 202 about an axis, such that the axis is running parallel to and centered in the output axle 202. The edges 208A and 208B of each of the helical tabs 204A and 204B are formed into hook shapes.

Figure 2C:
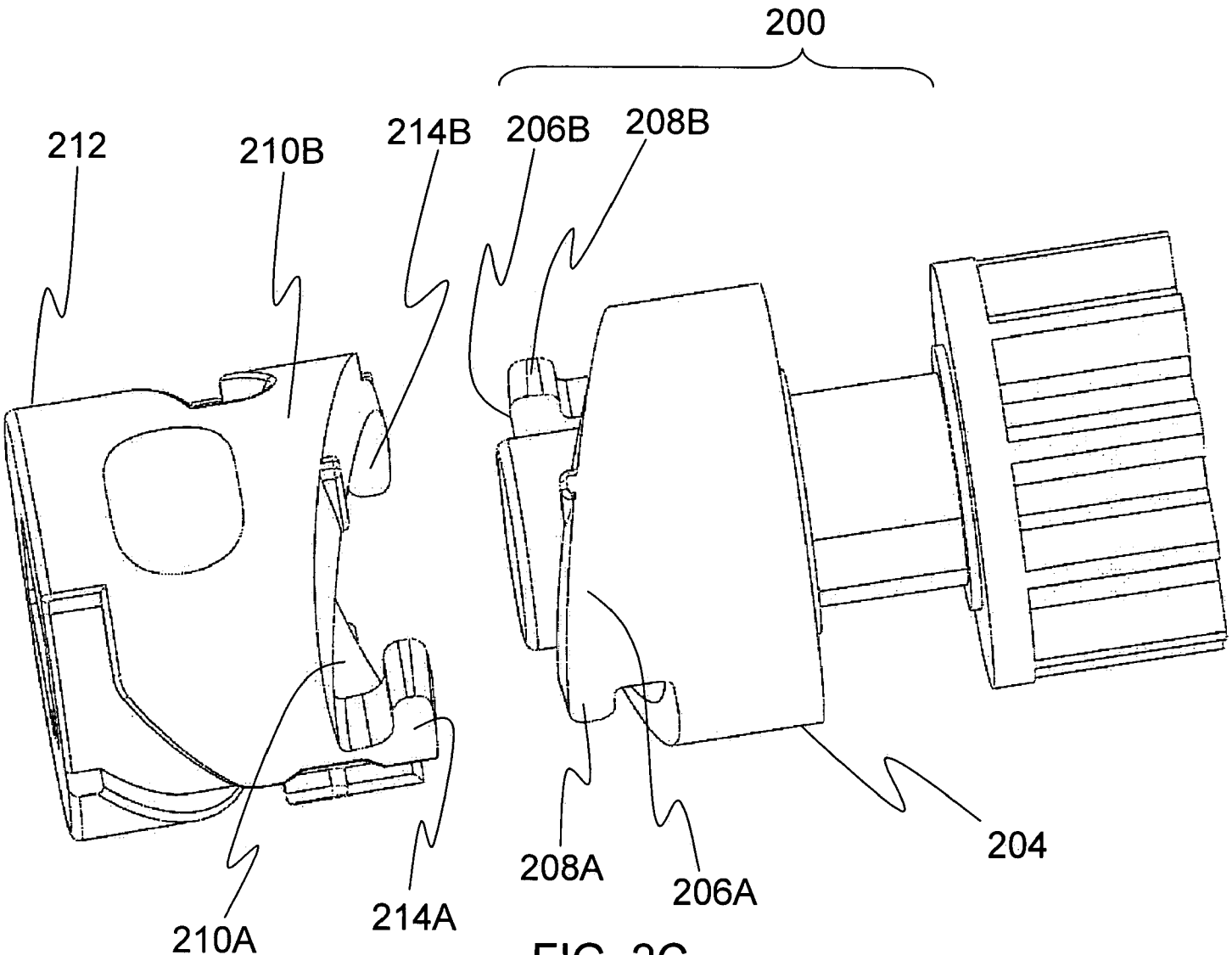
FIG. 2C is an exemplary illustration of a toy according to the present invention, depicting the relationship of the structure of the driving element with a receiving element.
Figure 2D:
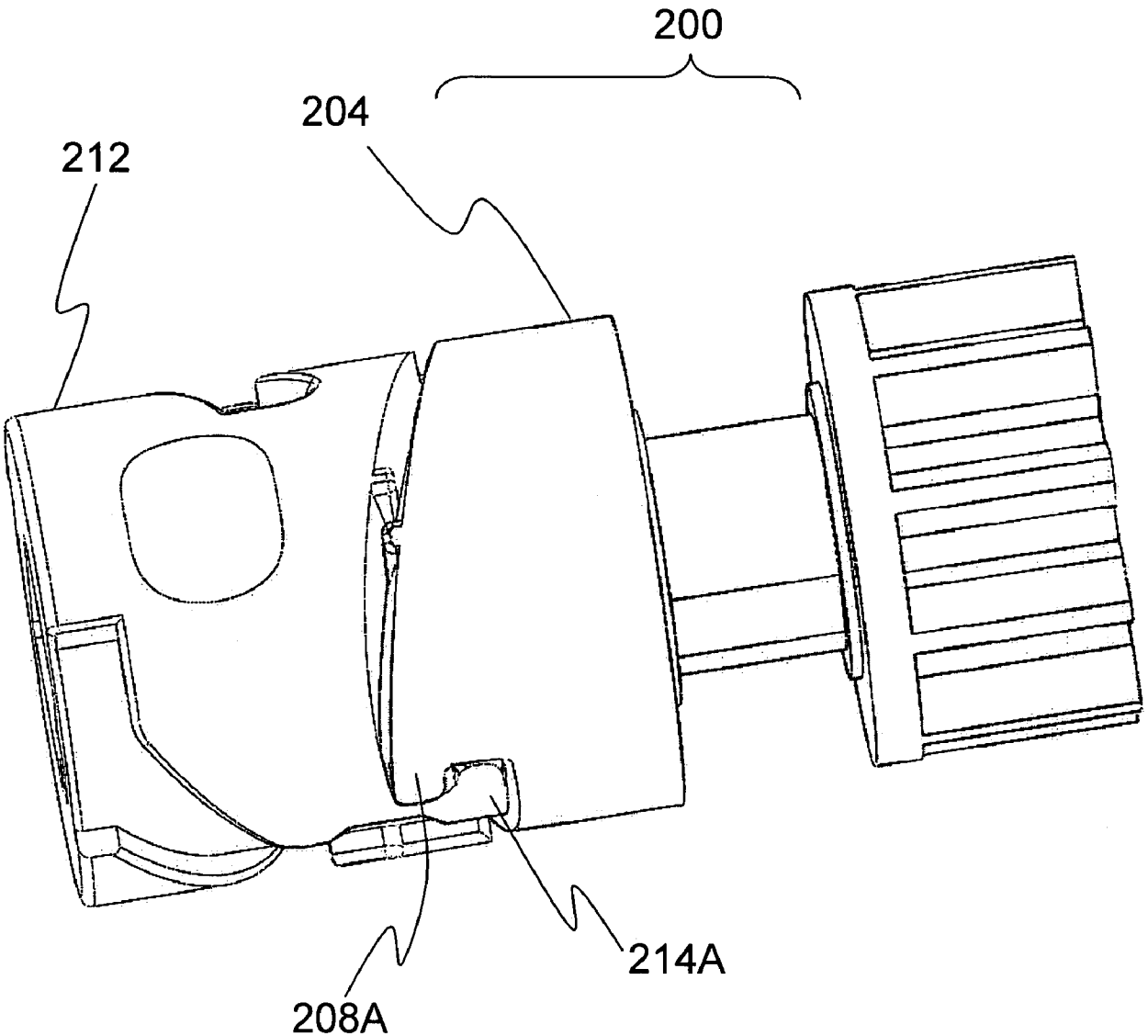
FIG. 2D is an exemplary illustration of a toy according to the present invention, depicting an interlocking drive connection between the driving element and the receiving element.

FIG. 2C illustrates how the helical tabs 206A and 206B of the driving element 204 are configured to interlock, as matching and interlocking shapes, with similar helical tabs 210A and 210B on a receiving element 212, the receiving element 212 connected with an object to be rotated (not illustrated). In particular, the hook-shaped edges 208A and 208B of the driving element 204 are configured to match up with the hook-shaped edges 214A and 214B of the receiving element, forming an interlocking drive connection. The interlocking drive connection, as illustrated in FIG. 2D, allows a user to rotate the toy in any orientation and still maintain the interlocking drive connection between the driving element 204 and the receiving element 212.

Once the interlocking drive connection is made between the driving element 204 and the receiving element 212, the user can pull the gear rack (not illustrated) to rotate the driving element 204 and thereby rotate the object connected with the receiving element 212. When the user pulls the gear rack to the point that it is no longer in contact with the launcher rotating system, the launcher rotating system ceases to accelerate the launcher 200 and the driving element 204. Once the driving element 204 ceases to accelerate the receiving element 212, the receiving element 212 disengages from the driving element 204 and releases the object from the interlocking drive connection. This is accomplished because once the launcher rotating system ceases to rotate the driving element 204, the rate of rotation of the driving element 204 decreases immediately. However, due to the object's inertia, the rotational velocity of the receiving element 212 decreases more slowly, and the object and receiving element rotate away from the driving element 204 and disengage from the interlocking drive connection.

Due to the design of the launcher 200 and specifically the helical tabs 206A and 206B of the driving element 204, the rotation of the launcher 200 will impart a rotation to the receiving element 212 only if rotated in a clockwise direction. If the launcher 200 is rotated in a counter-clockwise direction, the hook-shaped edges 208A and 208B of the driving element will rotate away from the hook-shaped edges 214A and 214B of the receiving element 212 and disengage the interlocking drive connection without imparting any rotational motion to the receiving element 212.

Figure 2E:
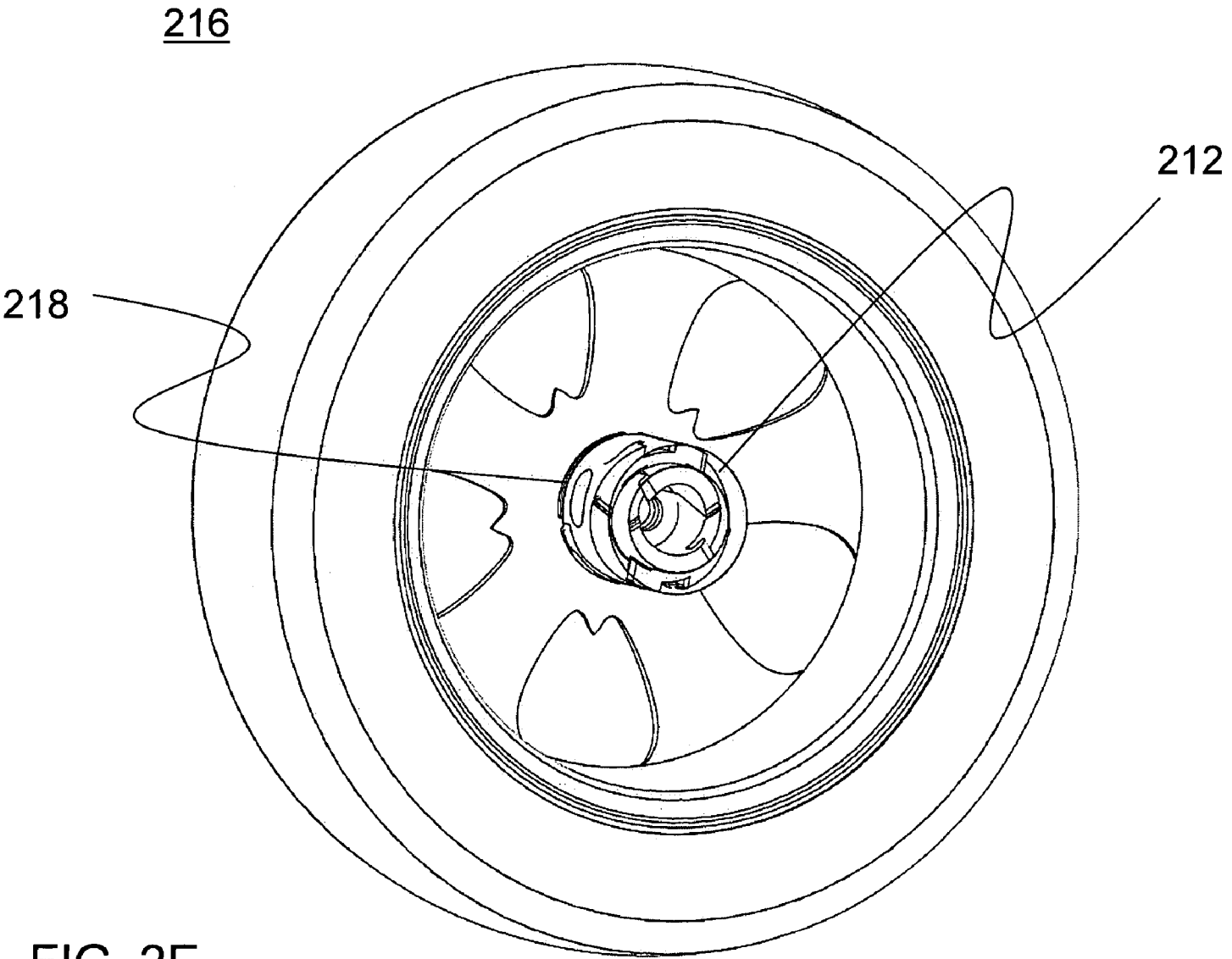
FIG. 2E is an exemplary illustration of a toy according to the present invention, depicting a wheel configured with the receiving element.

In the aspect where the object is a wheel 216, the receiving element 212 is rotationally connected with the hub 218 of the wheel, as illustrated in FIG. 2E.

(4) Launcher Rotating System

Figure 3A:
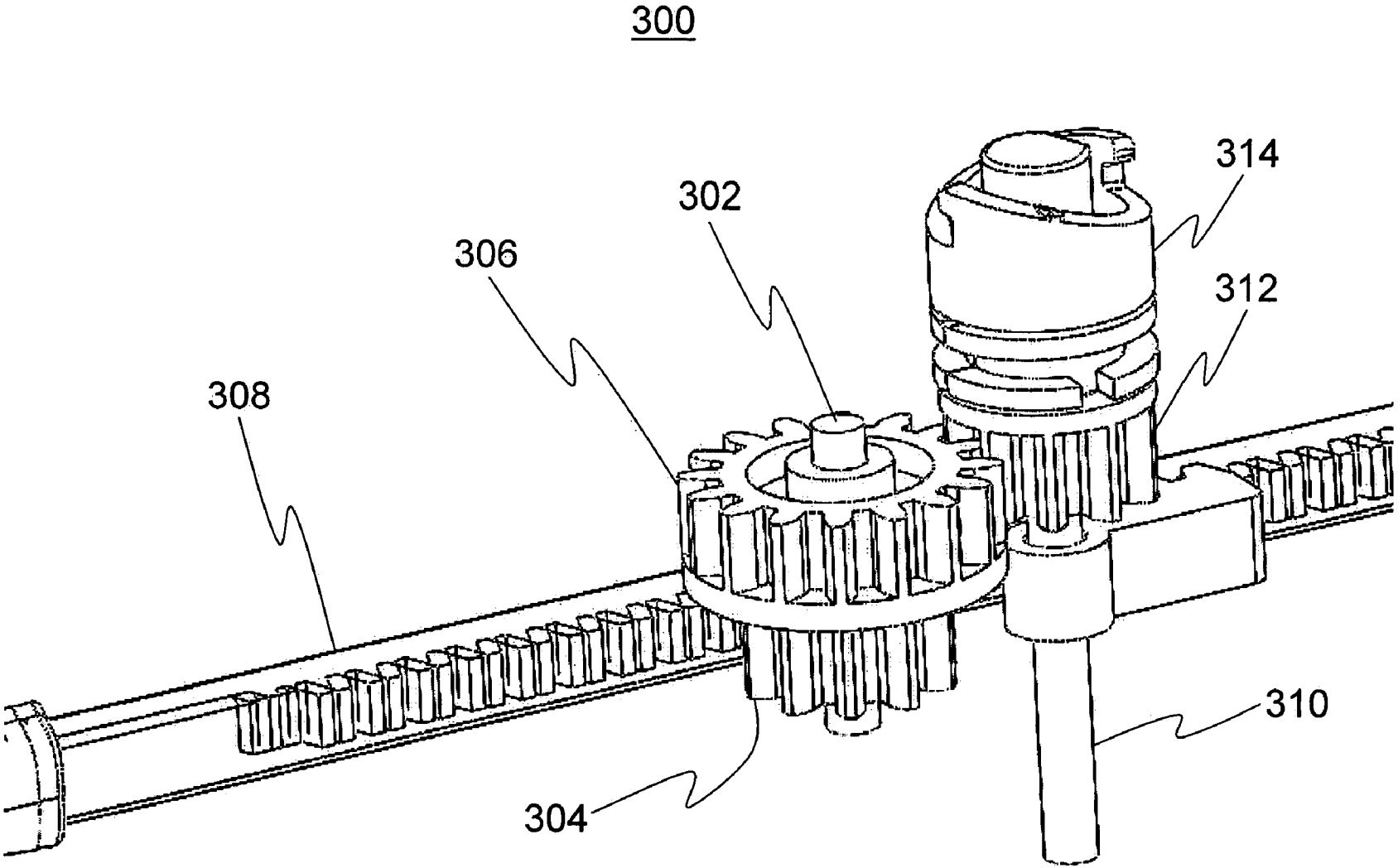
FIG. 3A is an exemplary illustration of a toy according to the present invention, depicting a launcher rotating system comprising an input axle, input pinion, input gear, output gear, output axle and launcher, the input pinion drivingly connected with the gear rack.

The launcher rotating system comprises a series of interconnected gears and axles to impart a rotary motion to the launcher. In one aspect, as illustrated in FIG. 3A, the launcher rotating system 300 comprises an input axle 302 with an input pinion 304 and an input gear 306, where the input pinion 304 is drivingly connected with a gear rack 308. The launcher rotating system 300 further comprises an output axle 310 with an output gear 312, where the output gear 312 is drivingly connected with the input gear 306, and where the output axle 310 is connected with the launcher 314.

Figure 3B:
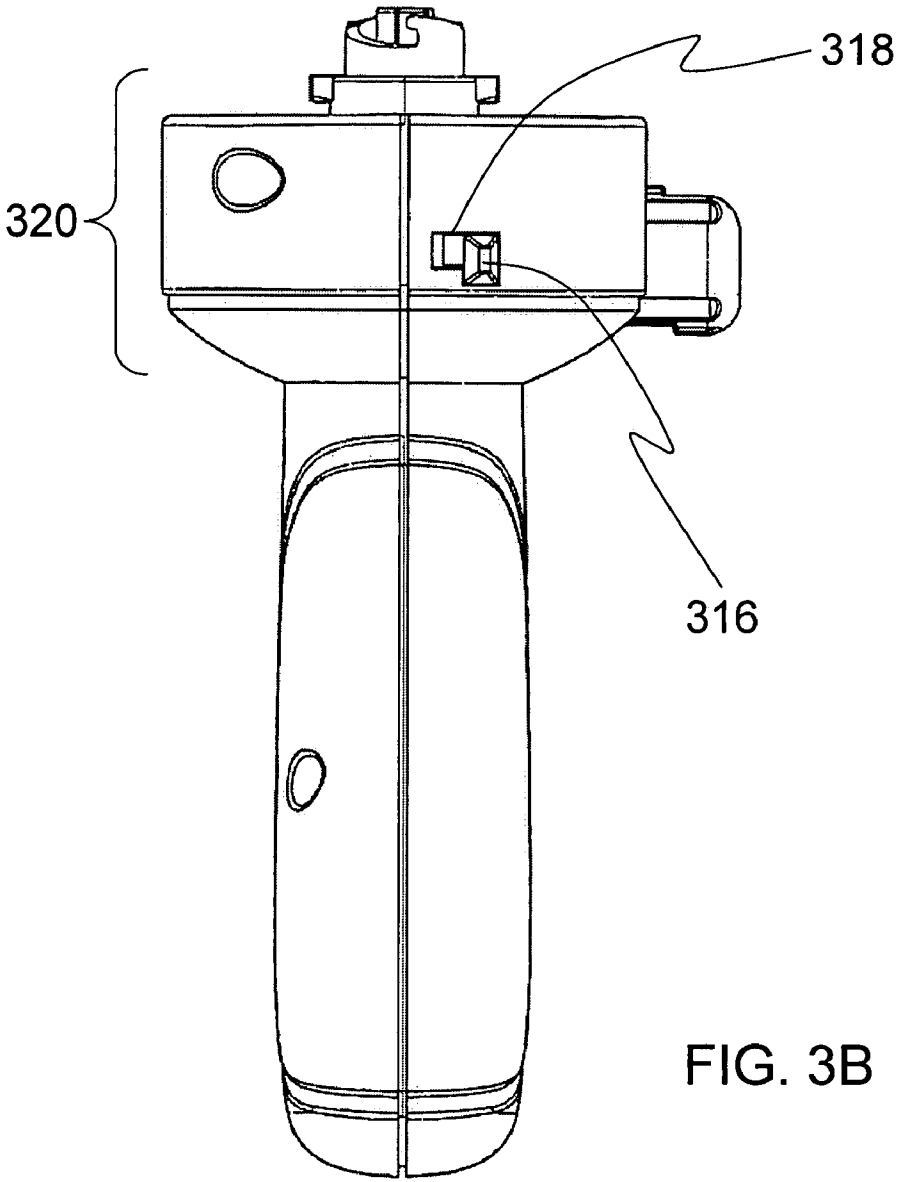
FIG. 3B is an exemplary illustration of a toy according to the present invention, depicting the housing with a guideway for inserting the gear rack.
Figure 3C:
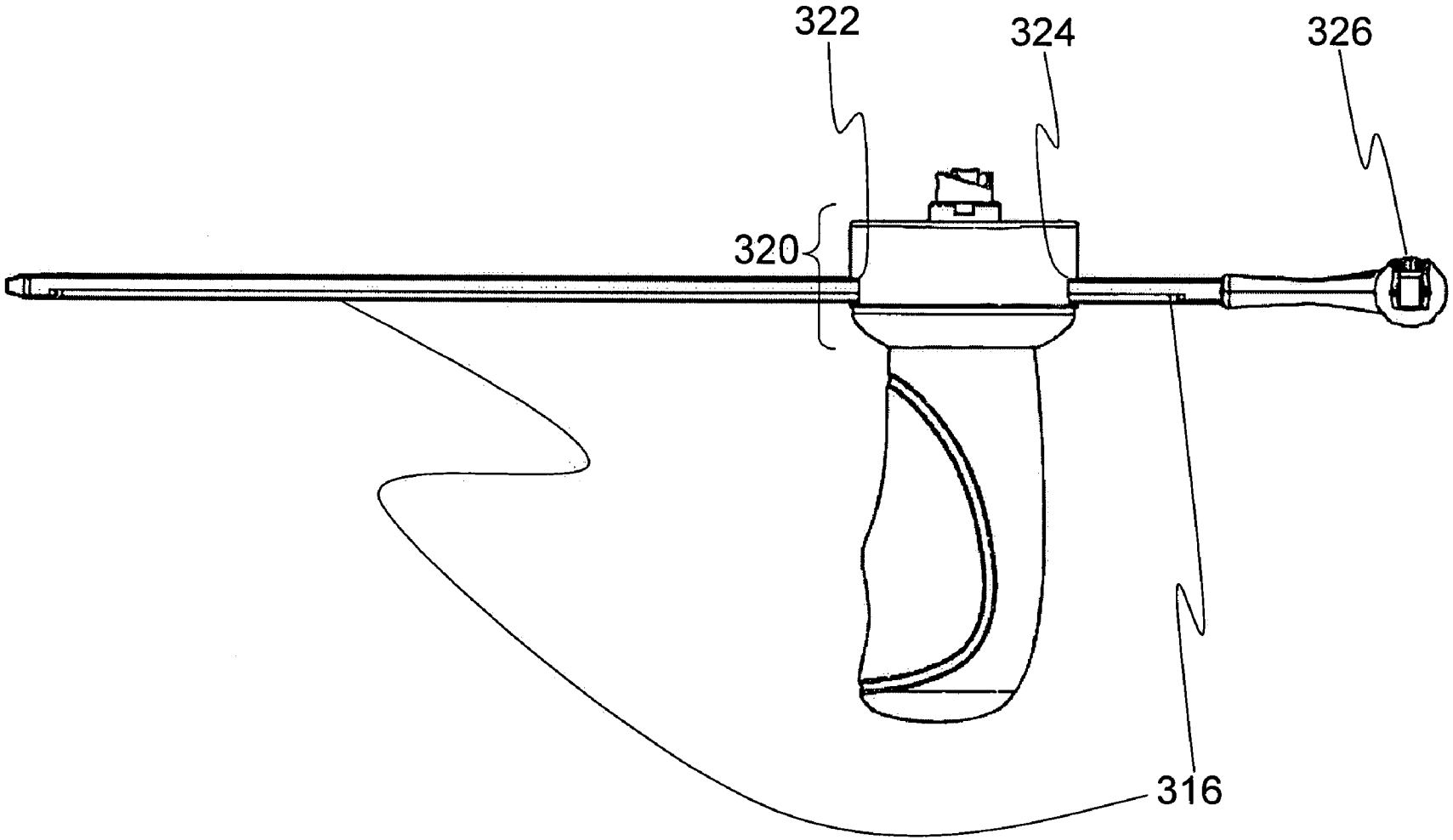
FIG. 3C is an exemplary illustration of a toy according to the present invention, depicting the gear rack inserted into the guideway in the housing.

In one aspect, as illustrated in FIG. 3B, the gear rack 316 is movably mounted in a guideway 318 in the housing 320. FIG. 3C further illustrates how the gear rack 316 is inserted into a guideway (not illustrated) that requires openings 322 and 324 on corresponding ends of the housing 320. The gear rack 316 further comprises a handle 326 for a user to easily grip and pull the gear rack 316.

One skilled in the art will appreciate that by changing the radius of the interconnected gears and input pinions of the launcher rotating system, a desired input-to-output gear ratio can be achieved. For example, the radius of the gears and pinions can be reduced to provide for a faster rotation output to the launcher, due to the fact that a given movement of the gear rack produces more revolutions of the gears and input pinions than are produced with a greater radius of the gears and input pinions.

(5) Stopper Mechanism

Figure 4:
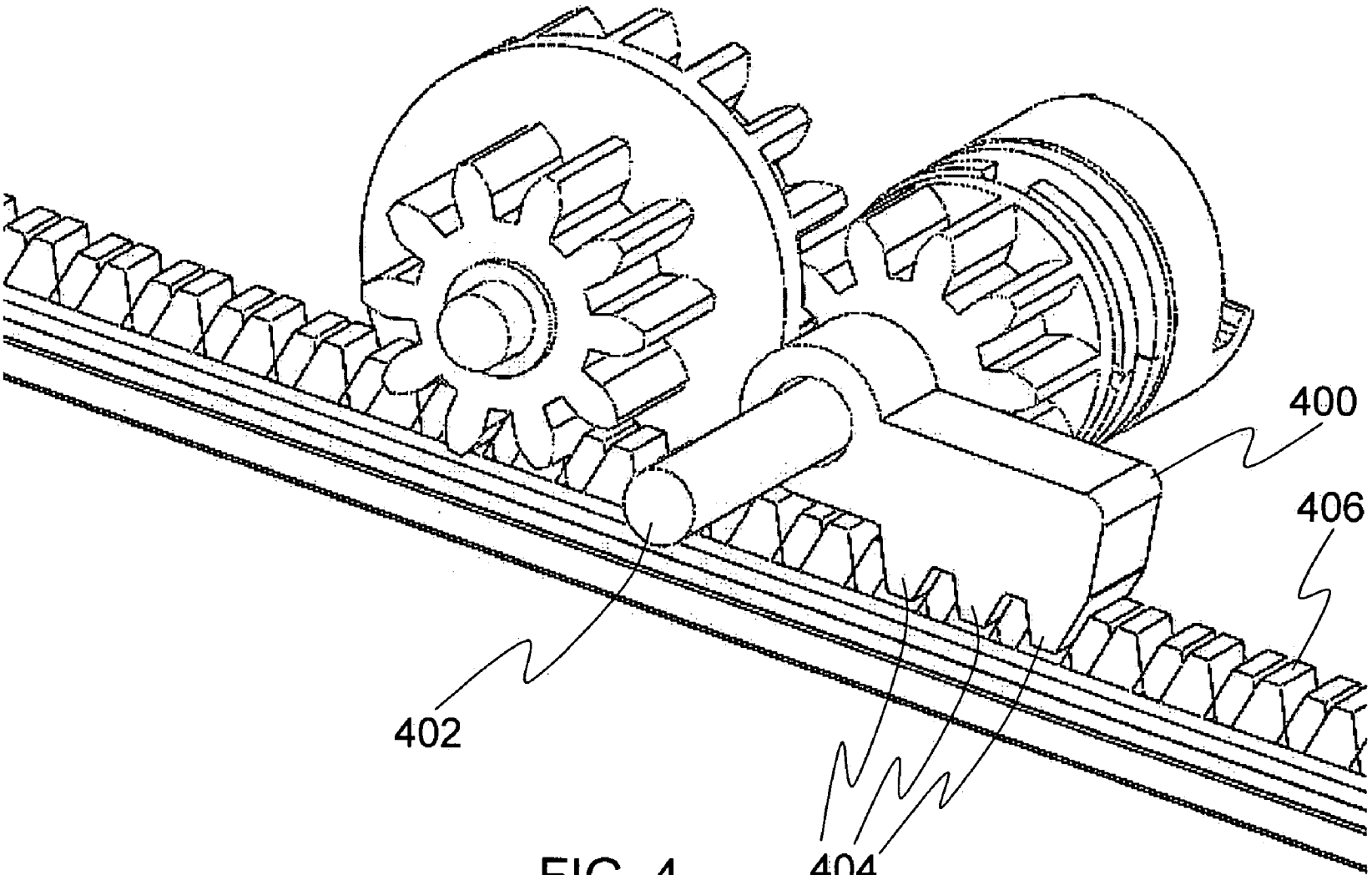
FIG. 4 is an exemplary illustration of a toy according to the present invention, depicting a stopper mechanism rotationally attached to the input axle of the launcher rotating system and interlocking with the gear rack.

An additional aspect of the toy is a stopper for preventing the object from rotating and launching in an undesired direction, e.g., in the direction of a user. In one aspect, illustrated in FIG. 4, the stopper 400 is rotationally attached to the input axle 402 of the launcher rotating system. The stopper 400 is formed with teeth 404 to interlock with the gear rack 406 and prevent the gear rack 406 from moving. The stopper 400 is rotationally configured such that when the user is operating the toy as designed, the stopper 400 does not interact with the gear rack 406. However, if the toy is oriented in a way such that a pull of the gear rack 406 would result in the rotation and launch of the object in the direction of the user, the stopper 400 rotates into a position in which it interlocks with the gear rack 406, thereby preventing the gear rack 406 from being pulled.

One skilled in the art will appreciate that the stopper may consist of any mechanism designed to prevent the rotation and launch of the object in the direction of the user. For example, if the launcher rotating system comprises a motor, the motor may possess a device to detect a particular orientation of the device and thereby prevent the motor from operating in that orientation.

(6) Multiple Object Launcher

Figure 5A:
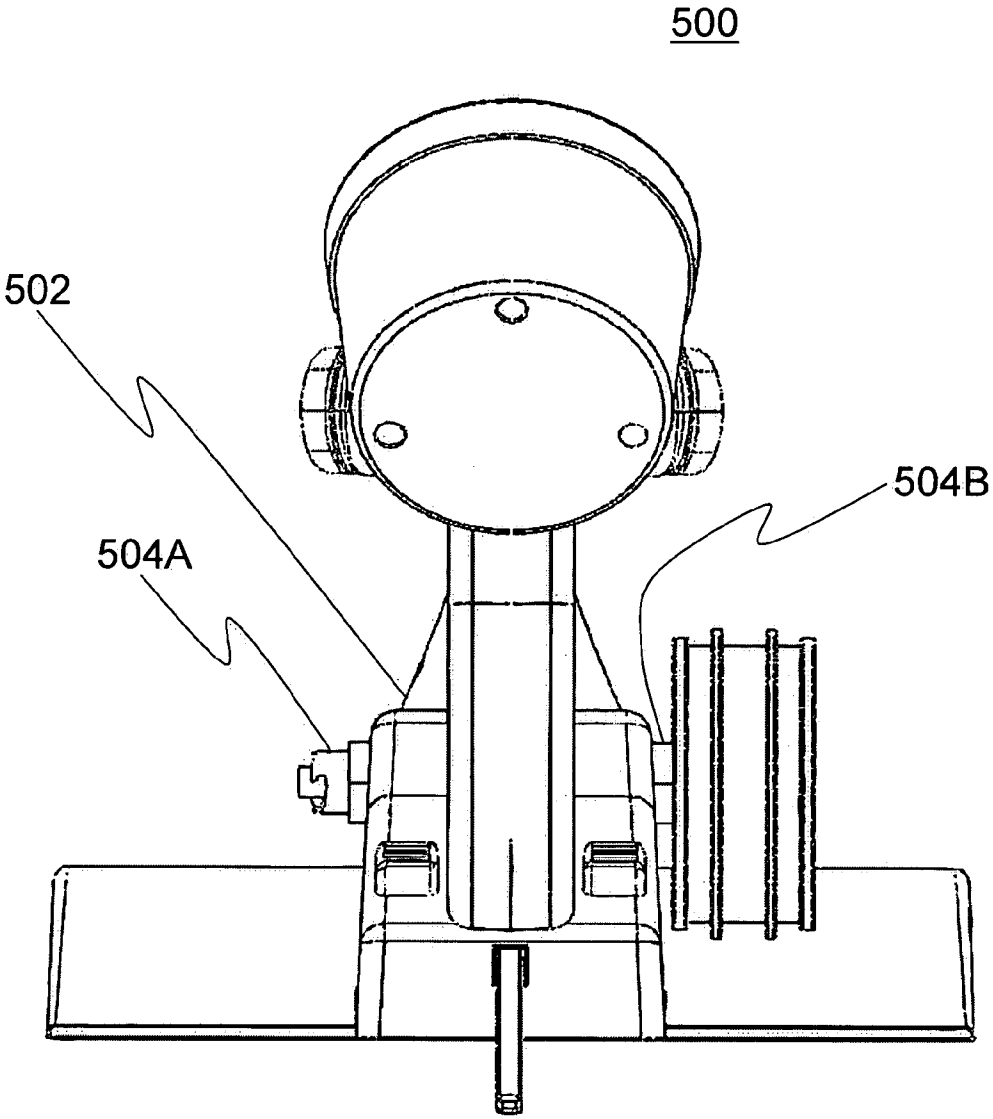
FIG. 5A is an exemplary illustration of a toy according to the present invention, depicting a multiple object launcher with a housing, a first launcher and a second launcher, the second launcher connected with an object.
Figure 5B:
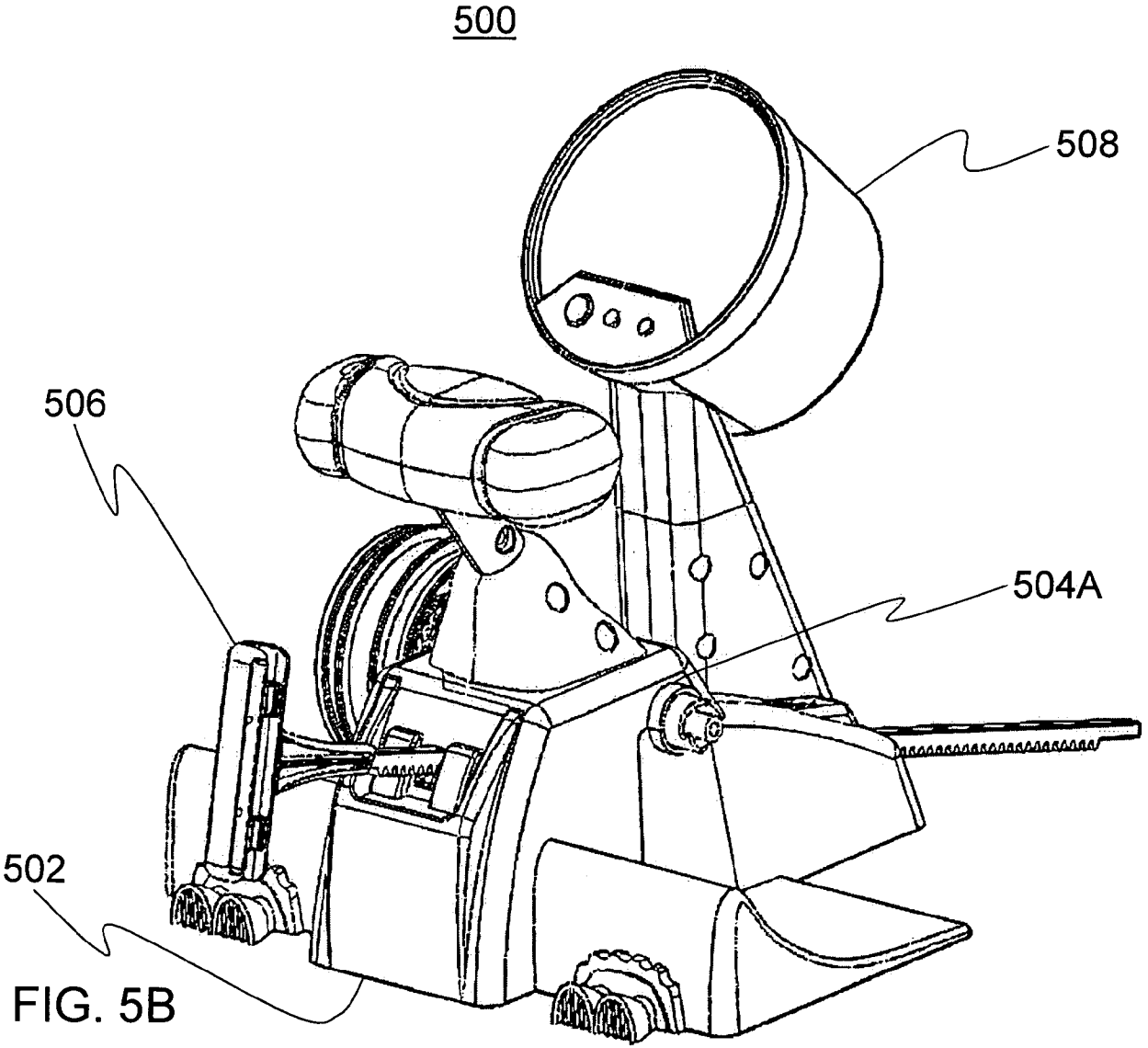
FIG. 5B is an exemplary illustration of a toy according to the present invention, depicting the multiple object launcher with a rip cord passing through a guideway and a gauge for measuring the force of rotation imparted by the gear rack.

A multiple object launcher is also conceived where the toy rotates and launches more than one object from at least two different launchers located on at least two different sections of the housing. FIG. 5A illustrates one aspect of the multiple object launcher 500, wherein the housing 502 comprises openings for a first launcher 504A and a second launcher 504B. FIG. 5B further illustrates how an object, such as a wheel, is attached to the second launcher 504B. The housing 502 encloses a modified launcher rotating system (not illustrated) to rotate and launch two objects side-by-side. FIG. 5B illustrates one aspect of the multiple object launcher, where a gear rack 506 is pulled by a user to simultaneously rotate two launchers 504A and 504B (504B is not illustrated). In a further aspect, the multiple object launcher is fitted with a gauge 508 to measure the velocity of the movement of the gear rack 506 when pulled by a user.

Figure 5C:
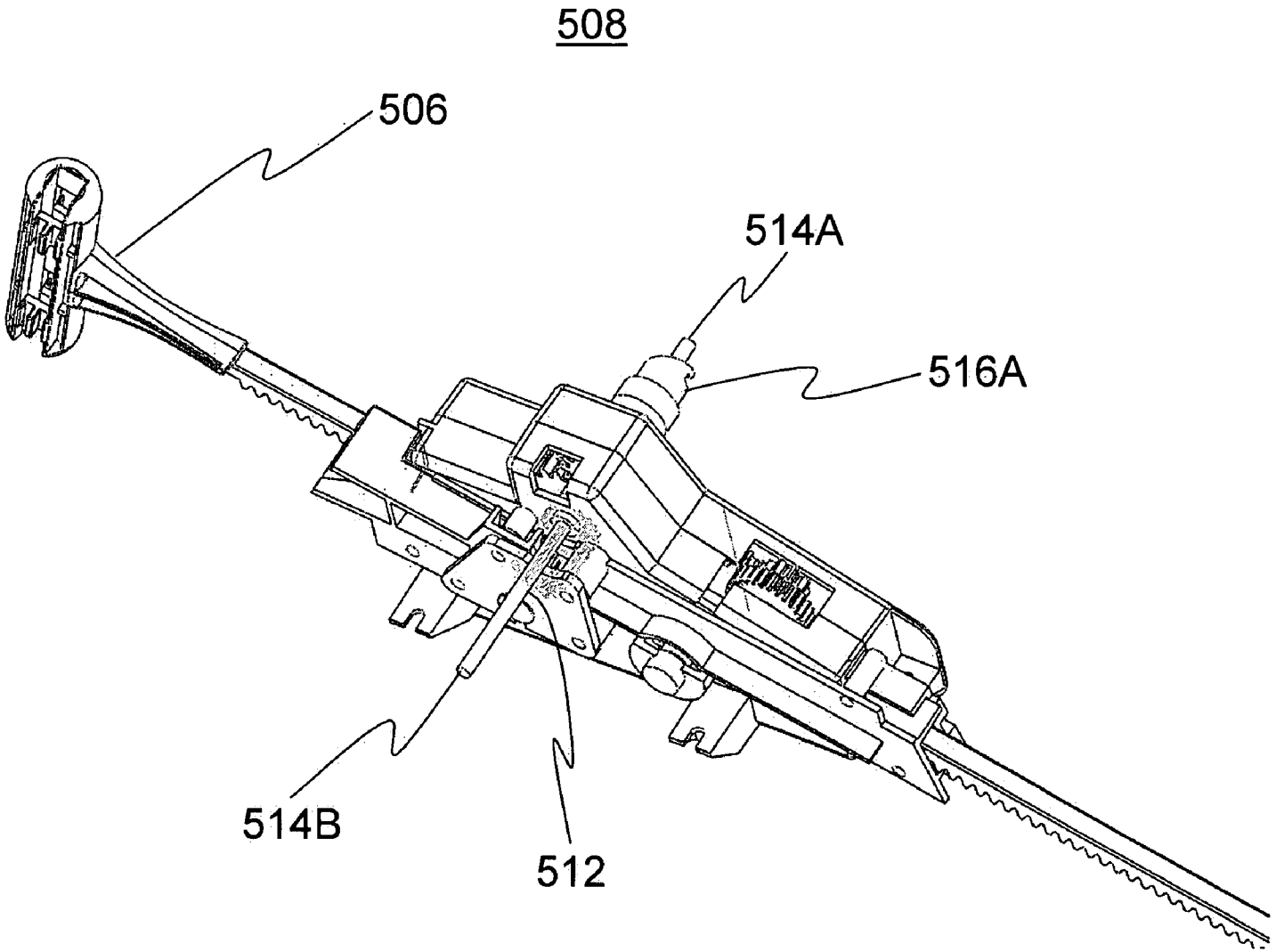
FIG. 5C is an exemplary illustration of a toy according to the present invention, depicting the internal structure of the multiple object launcher including a launcher rotating system and the gear rack, along with a launcher connected with a first end of the output axle.

FIG. 5C is a deconstructed view of the multiple object launcher which illustrates the launcher rotating system contained within an internal housing 510 of the multiple object launcher. A gear rack 506 is drivingly connected with a launcher rotating system, and the launcher rotating system is rotationally connected with a shaft 512, wherein the shaft 512 has a first end 514A and a second end 514B, each respective end fitted with a launcher 516A and 516B (516B is not illustrated).

Figure 5D:
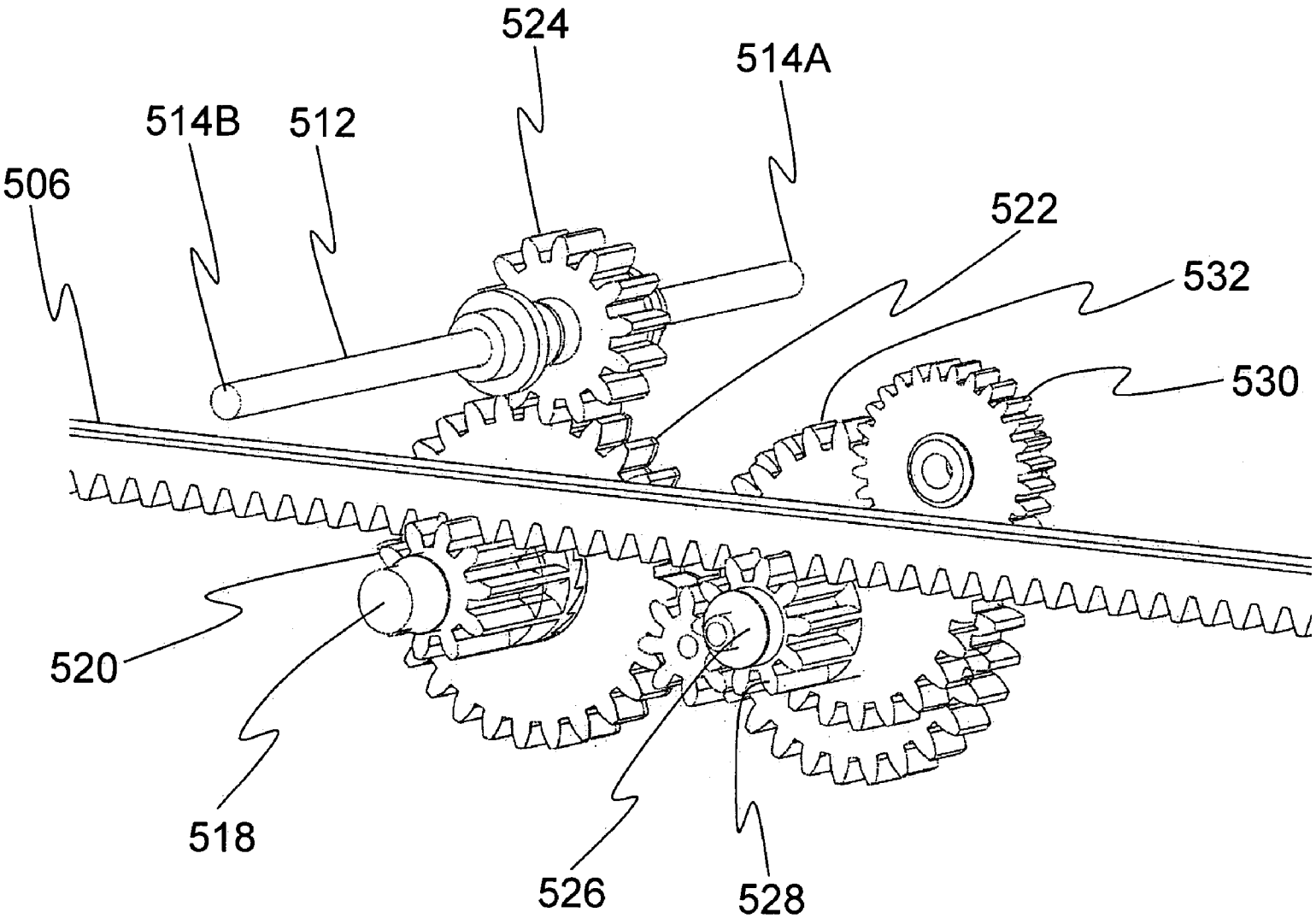
FIG. 5D is an exemplary illustration of a toy according to the present invention, depicting the launcher rotating system and a gauge rotating system drivingly connected with the gear rack.

FIG. 5D illustrates the shaft rotation system of the multiple object launcher. An input axle 518 comprises an input pinion 520 and an input gear 522, the input pinion 520 configured to drivingly connect with the gear rack 506. The input gear 522 is then configured to interact with an output axle gear 524, the output axle gear 524 drivingly connected with the output axle 512.

The launcher rotating system further comprises a gauge rotating system drivingly connected with the launcher rotating system and the gear rack 506 to provide a measurement of the rate of rotation to a gauge (not illustrated). The gauge rotating system comprises a gauge axle 526 drivingly connected with a gauge input pinion 528, an equalizing gear 530, and a gauge measuring gear 532. The gauge input pinion 528 interacts with the gear rack 506 and rotates the gauge axle 526, which thereby rotates the equalizing gear 530 and the gauge measuring gear 532. The gauge measuring gear 532 is connected with a shaft (not illustrated) to translate the movement of the gear rack 506 into a measured rate of rotation.

(7) Rapid-Fire Launcher

Figure 6A:
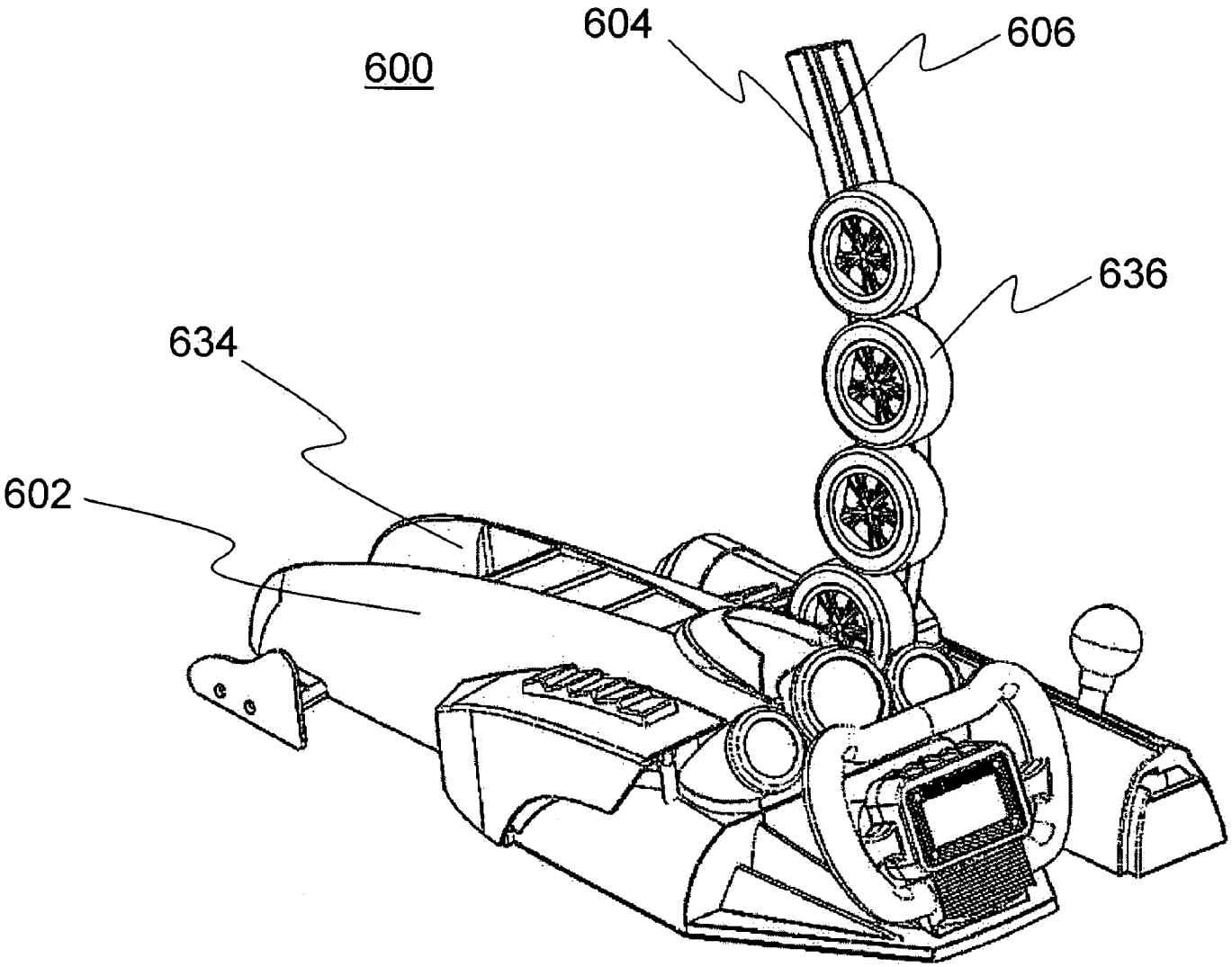
FIG. 6A is an exemplary illustration of a toy according to the present invention, depicting a rapid-fire launcher comprising a housing and a clip to load multiple objects to be rotated and launched in sequence.

A rapid-fire object launcher is also conceived to sequentially load, rotate, and launch a plurality of objects. FIG. 6A illustrates one aspect of the rapid-fire launcher 600, wherein the housing 602 is connected with a clip 604. The clip 604 is formed to hold a plurality of objects 636, such as wheels, within a groove 606 that sequentially loads the objects into the housing 602, where the objects 636 form a connection with the launcher rotating system to rotate and launch the object.

Figure 6B:
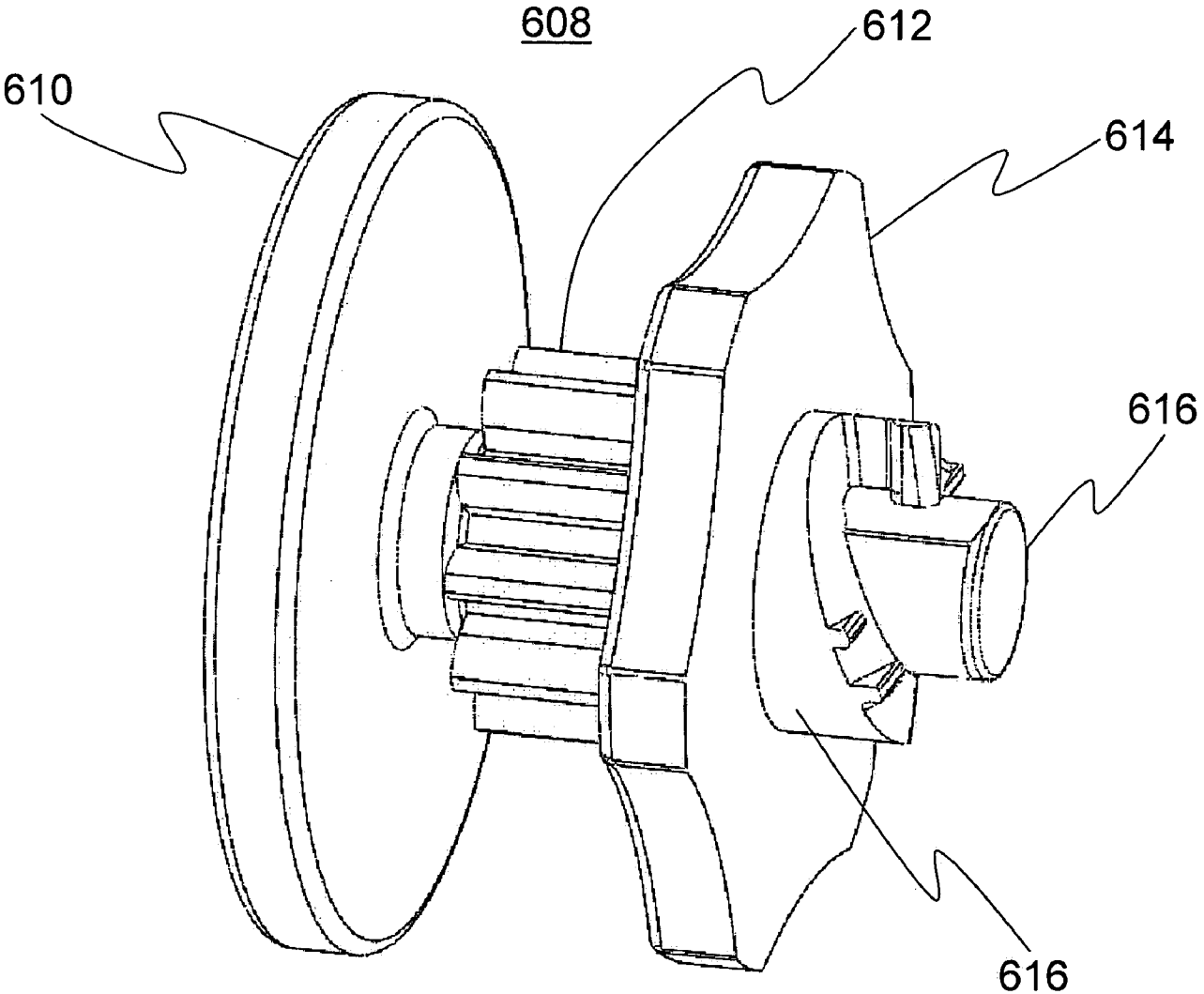
FIG. 6B is an exemplary illustration of a toy according to the present invention, depicting a rotating element adaptor for the rapid-fire launcher.

The object is connected with the clip via a rotating element adaptor 608, as illustrated in FIG. 6B, which functions to load the object onto the clip. The rotating element adaptor 608 has three sections: a disc portion 610, a gear portion 612, and a launcher portion 614. The disc portion 610 and gear portion 612 are rotationally connected by a central shaft 616, while the gear portion 612 is connected with the launcher portion 614 such that the gear portion 612 and launcher portion 614 rotate as one piece. The rotating element adaptor 608 also functions to connect with the launcher rotating system in the housing 602 to rotate and launch the object. The launcher portion 614 of the rotating element adaptor 608 comprises a driving element 616 to form an interlocking drive connection with a receiving element (not illustrated) rotationally connected with the object.

Figure 6C:
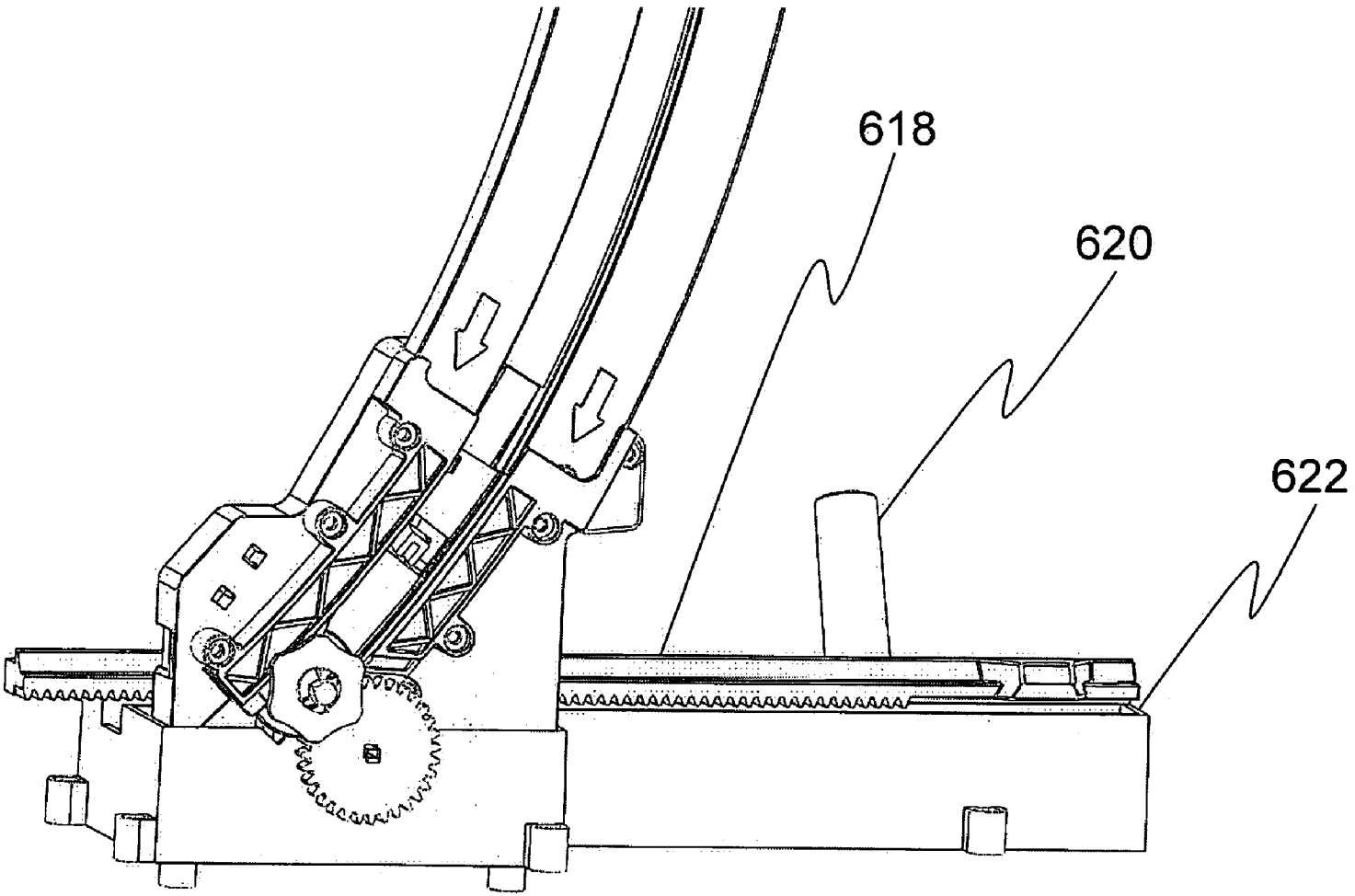
FIG. 6C is an exemplary illustration of a toy according to the present invention, depicting a gear rack drivingly connected with a launcher rotating system of the rapid-fire launcher.

The rapid-fire launcher further comprises a gear rack 618 drivingly connected with the launcher rotating system to rotate and launch the object and contained entirely within the housing 602 (not illustrated), as illustrated in FIG. 6C. The gear rack is connected with a handle 620 and movably mounted to the housing 602 to move the gear rack 618 along a guideway 622 formed in the housing.

Figure 6D:
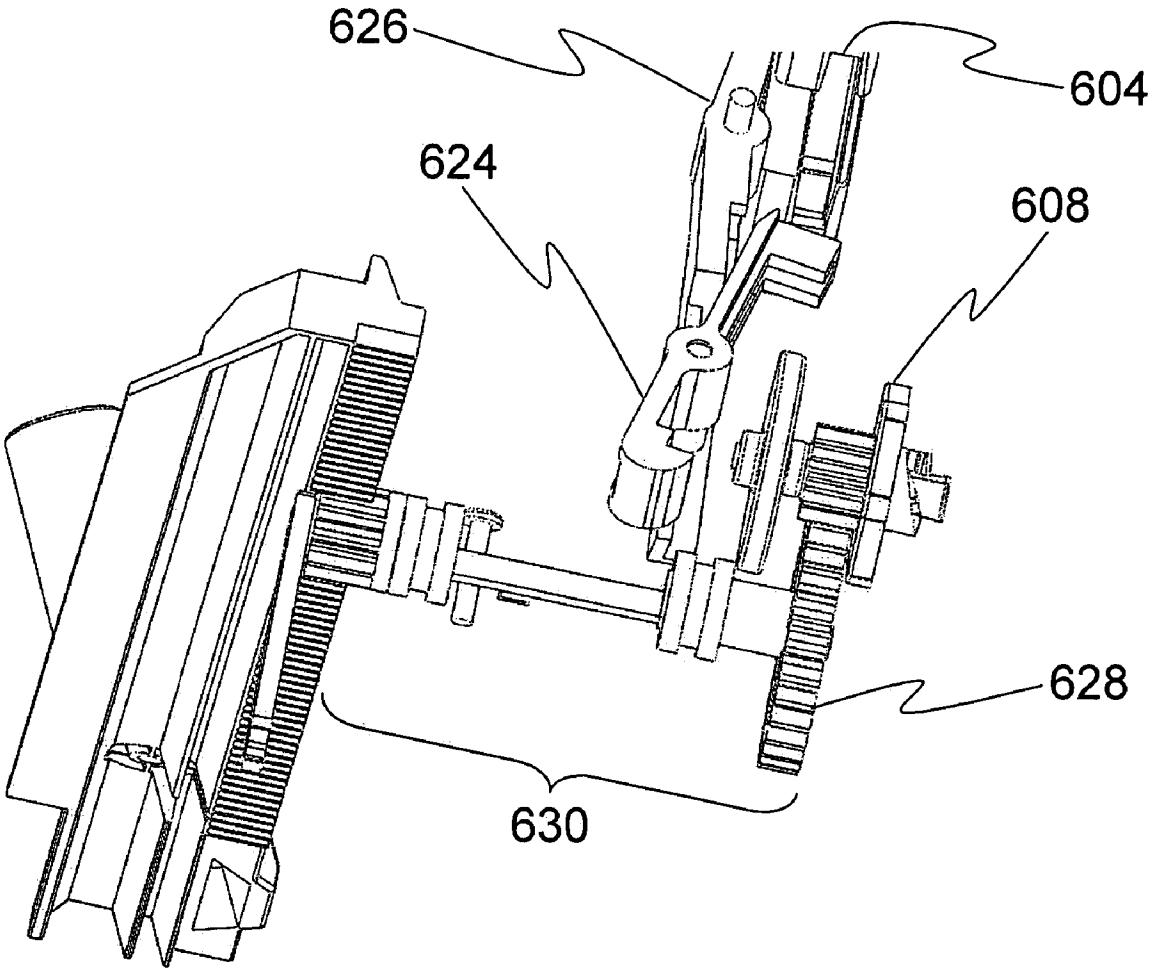
FIG. 6D is an exemplary illustration of a toy according to the present invention, depicting an object loading system of the rapid-fire launcher.
Figure 6E:
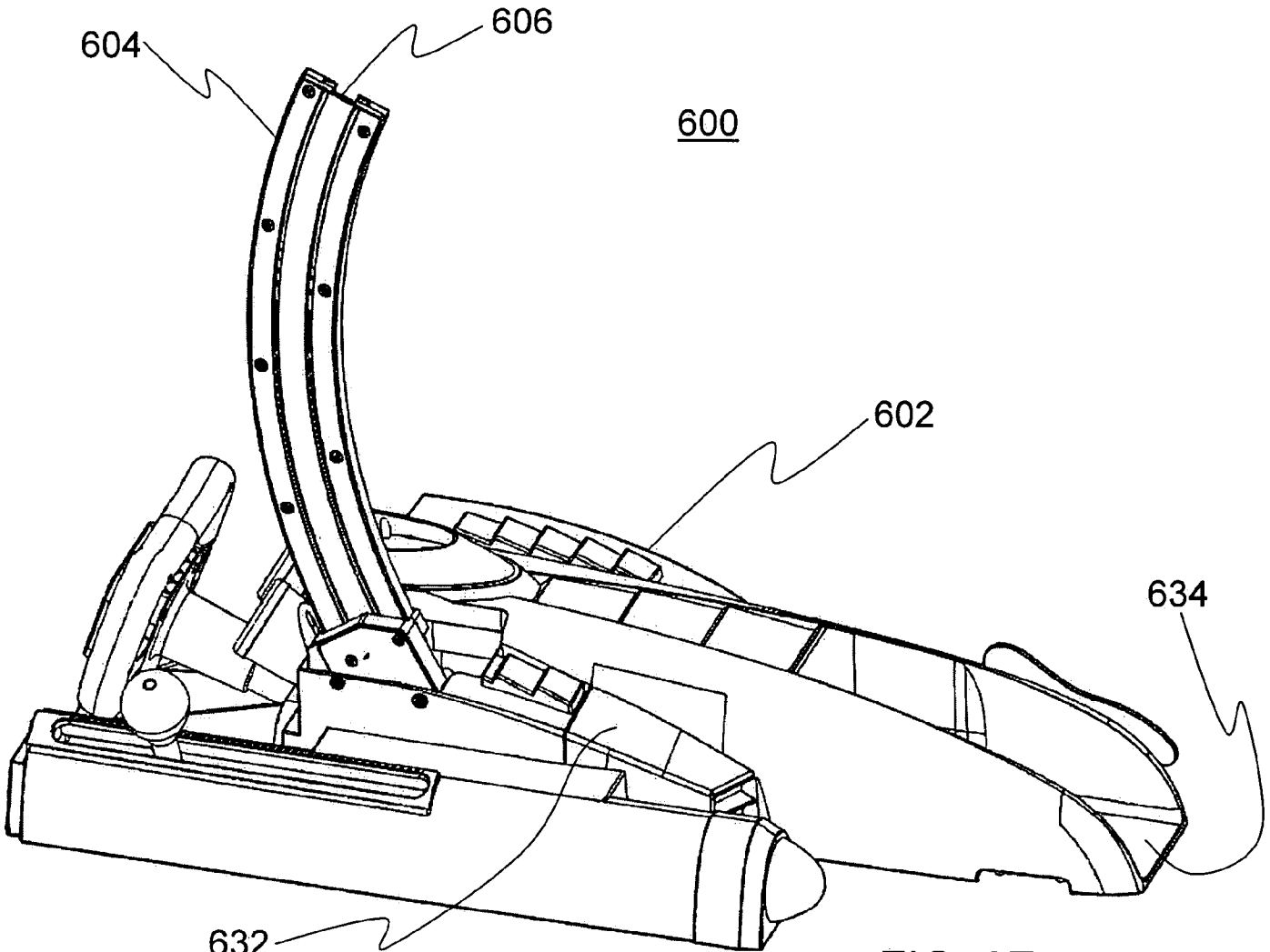
FIG. 6E is an exemplary illustration of a toy according to the present invention, depicting a storage area for the rotating element adaptor.

As the gear rack 618 is moved, the handle 620 interacts with an object loading system. The object loading system, as illustrated in FIG. 6D, functions to activate a first release lever 624 and a second release lever 626 to load the rotating element adaptor 608 and attached object (not illustrated) from the clip 604 into direct connection with an output gear 628 of the launcher rotating system 630. Once the launcher rotating system 630 rotates and launches the object (not illustrated) from the rotating element adaptor 608, the rotating element adaptor 608 is also released from the direct connection with the output gear 628. The rotating element adaptor 608 is then released into a storage area 632 of the housing 602, as shown in FIG. 6E.

The object loading system is therefore designed to load another rotating element adaptor 608 in the same motion of the gear rack 618 that rotates and launches an object. This function can be performed numerous times until the amount of objects loaded on the clip 604 are launched.

The housing is configured with a launch opening 634 to guide the object out of the housing. In one aspect, the housing is formed in the shape of a race car, wherein the launch opening 634 is a nose of the race car.

(8) Further Aspects of the Object

Figure 7C:
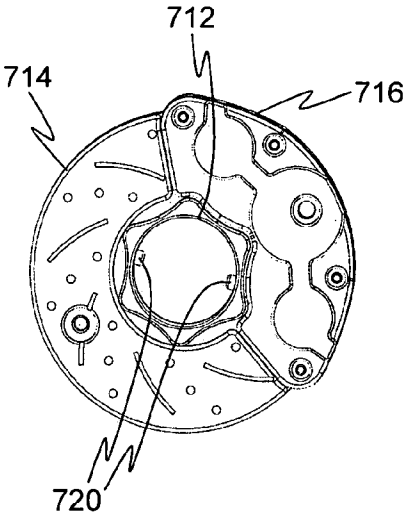
FIG. 7C is an exemplary illustration of a toy according to the present invention, depicting a pair of protrusions to connect the toy brake caliper and rotor with the receiving element.
Figure 7B:
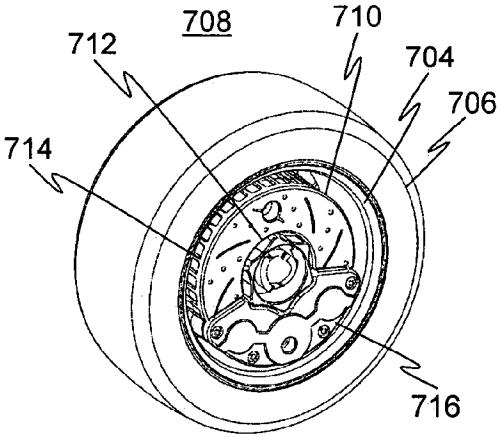
FIG. 7B is an exemplary illustration of a toy according to the present invention, depicting a wheel comprising a toy brake caliper and rotor connected with the receiving element.
Figure 7A:
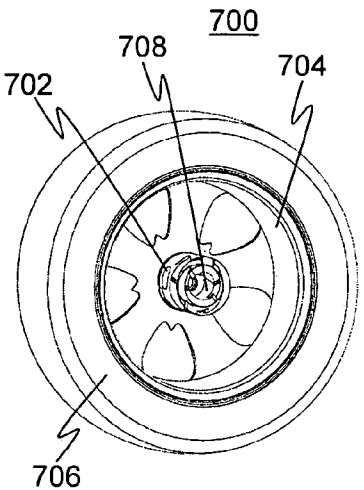
FIG. 7A is an exemplary illustration of a toy according to the present invention, depicting a wheel comprising a hub, rim and tire connected with a receiving element.

In one aspect of the toy, the object to be rotated and launched is a wheel 700, as illustrated in FIG. 7A. The wheel has a hub 702, a rim 704 and a tire 706, and is designed to simulate the look of an automobile wheel. A receiving element 708 is rotationally connected with the hub 702 such that the wheel 700 is centrally rotated when the user initiates a pull on the gear rack. The rim 704 is connected with the hub 702 and forms the basic circular structure of the wheel 700. A tire 706 is then detachably attached to the rim 704. The tire 706 can be replaced with another tire should the user decide to attach different styles of tires or should the tire wear out.

To further imitate the look of an automobile tire, the wheel, in another aspect, can include a detachably attachable toy brake rotor. FIG. 7B illustrates a wheel 700 with the attached toy brake rotor 710. The toy brake rotor comprises an inner ring 712 and an outer ring 714. The toy brake rotor also includes a toy brake caliper 716 formed on the outer ring 714.

The toy brake rotor 710 can be easily detached and reattached so a user can swap out different types or styles of toy brake rotors. FIG. 7C and FIG. 7D illustrate how the toy brake rotor 710 is connected with a receiving element 718. The toy brake rotor 710 is detachably attached with the receiving element of the wheel through a set of protrusions 720 mounted on the inner ring 712 of the toy brake rotor 710. The protrusions 720 frictionally fit into a corresponding pair of grooves 722 on the receiving element 718, the grooves 722 extending parallel to a central axis and along the outer wall of the receiving element 718. The grooves 722 then extend perpendicular to the central axis of the receiving element 718 so that the protrusions 720 lock into the grooves 722 to prevent the toy brake rotor 710 from easily being pulled off.

Figure 7E:
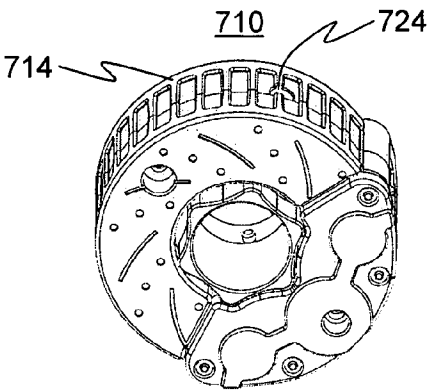
FIG. 7E is an exemplary illustration of a toy according to the present invention, depicting a light placed on an outer ring of the toy brake caliper and rotor.
Figure 7D:
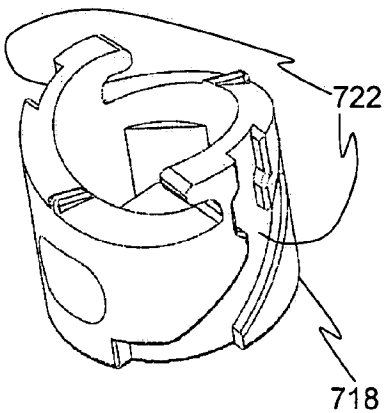
FIG. 7D is an exemplary illustration of a toy according to the present invention, depicting a pair of grooves on the receiving element to connect with the protrusions of the toy brake caliper and rotor.

In another aspect, as illustrated in FIG. 7E, the toy brake rotor 710 can be configured with a light 724 along the outer ring 714, such that when the wheel is spinning, the light 724 creates a streaking effect. The toy brake rotor further comprises a power source (not illustrated) to power the light. In one aspect, a pair of button cell batteries is used.

To provide for a greater streaking effect, the rim 704 and tire 706 can be transparent so that the light 724 can be seen through the rim 704 and tire 706. Another aspect could include a plurality of lights positioned all over the surface of the toy brake rotor to create an additional visual effect.

The light can be any type of lamp, bulb, or illuminating substance, but one aspect provides for the use of a light emitting diode ("LED"). The LED uses minimal power, is durable, and can be configured to provide a range of different colors.

In another aspect, the power source is activated by the centrifugal force of the wheel, such that the light only illuminates when the wheel is rotated.

One skilled in the art will appreciate that the use of the light could be applied to any object configured to be rotated and launched from the toy.

What is claimed is:

1. A toy for rotating and launching an object, comprising: a housing:

a launcher extending from the housing, the launcher configured to impart a rotary motion to an object, wherein the launcher comprises a driving element having an edge, the driving element configured to engage a receiving element having an edge, the edge of the driving element and the edge of the receiving element formed as hook shapes, such that when the edge of the driving element is matched up with the edge of the receiving element, an interlocking drive connection is formed, and the receiving element attached with an object to form a drive connection, such that when the driving element engages the receiving element, the object is rotationally accelerated in one direction, and wherein once the driving element ceases to accelerate the receiving element, the receiving element disengages from the driving element and releases the object from the drive connection;

a launcher rotating system mounted inside the housing and connected with the launcher, the launcher rotating system configured to impart a rotary motion to the launcher;

wherein the housing further comprises a detachably attachable clip for loading a plurality of objects in sequence, and wherein the clip is formed such that the objects are sequentially loaded into the launcher rotating system, such that as one object is rotated and launched, another object is loaded for into the launcher rotating system;

wherein the toy further includes an object, the object being rotationally connected with the receiving element to be rotationally accelerated by the driving element;

wherein the receiving element of the object is detachably attached with a receiving element adaptor; said receiving element adaptor configured with a disc portion, a gear portion, and a driving element portion, the disc portion, gear portion, and driving element portion connected by a central shaft; the disc portion configured to load into the central groove of the clip, the gear portion configured to interact with the launcher rotating system, and the driving element portion configured with a driving element to connect with the receiving element of the object and form a drive connection;

wherein the gear portion is connected with the driving element portion such that when the gear portion is rotated by the launcher rotating system, the driving element portion is simultaneously rotated;

wherein the launcher rotating system comprises an axle with an output portion and an input portion, the output portion comprising an output gear to interact with the gear portion of the receiving element adaptor, and wherein the input portion of the axle comprises an input pinion to interact with a gear rack;

wherein the gear rack is movably mounted in a guideway in the housing, the gear rack capable of moving to rotate the input pinion; and wherein the housing further comprises an object loading system configured to activate a load lever to release the receiving element adaptor from the clip and load the receiving element adaptor into a driving connection with the launcher rotating system.

2. The toy as set forth in claim 1, wherein the object loading system is activated by the gear rack.

3. The toy as set forth in claim 2, wherein the object loading system is further configured to activate a release lever to release the receiving element adaptor from the launcher rotating system after the object has been released from the drive connection of the driving element and receiving element.

4. The toy as set forth in claim 3, wherein the housing further comprises a guide configured to receive the disc portion of the receiving element adaptor after the receiving element adaptor has been released from the launcher rotating system, and wherein the guide directs the element adaptor to a desired location.

5. The toy as set forth in claim 4, wherein the housing is formed in a race car shape, the race car shape substantially enclosing the launcher rotating system and gear rack, and wherein the housing comprises a pathway to allow the object to exit the housing once the object has been released from the receiving element adaptor.

* * * * *